US005116717A

United States Patent [19]

Matsushita et al.

[11] Patent Number: 5,116,717

[45] Date of Patent: May 26, 1992

[54] SILVER HALIDE PHOTOGRAPHIC MATERIAL

[75] Inventors: Tetsunori Matsushita; Morio Yagihara, both of Kanagawa, Japan

[73] Assignee: Fuji Photo Film Co., Ltd., Kanagawa, Japan

[21] Appl. No.: 660,233

[22] Filed: Feb. 25, 1991

Related U.S. Application Data

[63] Continuation of Ser. No. 329,909, Mar. 28, 1989, abandoned.

[30] Foreign Application Priority Data

Mar. 28, 1988 [JP] Japan ..... 63-74249

[51] Int. Cl.[5] ..... G03C 1/06; G03C 1/34; G03C 1/42; G03C 7/32

[52] U.S. Cl. ..... 430/264; 430/219; 430/222; 430/223; 430/226; 430/443; 430/517; 430/519; 430/543; 430/544; 430/551; 430/559; 430/562; 430/564; 430/566; 430/598; 430/611; 430/613; 430/631; 430/955; 430/957; 430/958; 430/959

[58] Field of Search ..... 430/955, 957, 958, 959, 430/544, 443, 219, 226, 223, 222, 264, 551, 517, 543, 559, 564, 566, 598, 611, 613, 631, 519, 562

[56] References Cited

U.S. PATENT DOCUMENTS

| | | | |
|---|---|---|---|
| 3,615,617 | 10/1971 | Muller-Bardorff et al. | 430/957 |
| 4,052,213 | 10/1977 | Credner et al. | 430/544 |
| 4,499,181 | 2/1985 | Watanabe et al. | 430/957 |
| 4,659,651 | 4/1987 | Yagihara et al. | 430/542 |
| 4,728,598 | 3/1988 | Bailey et al. | 430/544 |
| 4,729,936 | 3/1988 | Kitaguchi et al. | 430/203 |
| 4,824,772 | 4/1989 | Ichijima et al. | 430/957 |
| 4,857,440 | 8/1989 | Begley et al. | 430/955 |
| 4,917,995 | 4/1990 | Kojima et al. | 430/955 |

OTHER PUBLICATIONS

Kestner et al., "Photographic elements and processes", *Research Disclosure*, No. 15157, Nov. 1976, pp. 68–74.

*Primary Examiner*—Richard L. Schilling
*Attorney, Agent, or Firm*—Sughrue, Mion, Zinn, Macpeak & Seas

[57] ABSTRACT

A silver halide photographic material composed of a support having thereon at least one silver halide photosensitive emulsion layer, at least one layer of the material containing a blocked photographic reagent precursor represented by formula (I):

(I)

wherein $X_1$ represents a divalent linking group containing a hetero atom bonded to the carbon atom, provided that $X_1$ is linked to the carbon atom by a group other than PUG represents a photographically useful group containing a hetero atom bonded to $X_1$; W represents =N— or $Y_1$ represents hydrogen or a group capable of being substituted; Z represents an atomic group necessary for forming a heterocyclic ring, provided that when W represents a the group adjacent to W in the heterocyclic ring is a group other than wherein $R_1$, $R_2$, $R_3$, $R_4$ and $R_5$ each represents hydrogen or or group capable of being substituted; and m is 0 or 1, with proviso that when m is 0, the photographically useful group represented by PUG is bonded to a carbon atom via heteroatom of PUG. The photographic materials have superior stability during storage, and are capable of releasing a photographic reagent with specifically required timing during processing, and in a wide pH range.

18 Claims, No Drawings

SILVER HALIDE PHOTOGRAPHIC MATERIAL

This is a continuation of application Ser. No. 329,909, filed Mar. 28, 1989, now abandoned.

FIELD OF THE INVENTION

This invention concerns photographic materials and, more specifically, it concerns photographic photosensitive materials which contain precursor compounds in which the active groups of photographically useful photographic reagents have been blocked.

BACKGROUND OF THE INVENTION

By pre-addition of photographically useful photographic reagents to photographic photosensitive materials, the effects which are realized are different from those observed when the reagents are included in a processing bath. The differences include, for example, the fact that photographic reagents which are liable to degradation by acids or alkalis, or under redox conditions, and which are unable to withstand long term storage in processing baths, can be used effectively. The processing bath composition can be simplified and adjustments can be made more easily, and it is possible for the required photographic reagents to act with the required timing, or in the required location. Thus the required photographic agents can be made to function in just a specified layer, or in the vicinity of a specified layer, in a multi-layer sensitive material, and the amount of the photographic reagent which is present can be varied as a function of silver halide development. However, if the photographic reagents are added to a photographic photosensitive material in an active form they may react with other components within the photographic photosensitive material during storage prior to processing, or they may be degraded by the effects of heat or oxygen, for example, and it may not be possible to realize the intended function at the time the material is processed. One way of overcoming this problem is to block the active group of the photographic reagent and to add the reagent to the photographic material in an essentially inactive form, which is to say as a photographic reagent precursor. In cases where the photographically useful reagent is a dye it is advantageous to block a functional group which has a major effect on the spectral absorbance of the dye and shifts the spectral absorbance to the short wavelength side or the long wavelength side so that there is no loss of photographic speed due to a filtering effect, even if it is included in the same layer as a silver halide emulsion which has a corresponding photosensitive spectral band. If the photographically useful reagent is an anti-foggant or a development inhibitor then it is possible to prevent an desensitizing action due to absorption on the photosensitive silver halide, or silver salt formation, during storage by blocking the active groups. By releasing these photographic reagents with the required timing there is an advantage that fogging can be prevented without loss of photographic speed; that over-development fogging can be prevented; and that development can be stopped at the required time. In cases where the photographically useful group is a developing agent, an auxiliary developing agent to a fogging agent, prevention of the occurrence of various photographically adverse effects due to the formation of semi-quinones or oxidized forms by aerial oxidation during storage can be prevented. Prevention of the formation of fogging nuclei during storage by preventing electron implantation in the silver halide can be achieved by blocking the active groups or adsorption groups, and this has the effect stabilizing processing.

The above mentioned active groups, functional groups and adsorption groups are referred to collectively as "active groups" herein.

The use of photographic reagent precursors as described above is a very effective means of improving the performance of photographic reagents but, on the other hand, these precursors must satisfy very rigorous requirements. That is to say, they must satisfy the conflicting requirements of remaining stable under storage conditions, and of permitting the diisociation of the blocking group with the required timing and the smooth and effective release of the photographic reagent during processing.

A number of techniques have been proposed in the past for resolving these problems.

Any of the known blocking groups can be used as blocking groups for photographic reagents. For example, use can be made of the acyl groups and sulfonyl groups disclosed in JP-B-48-9969, JP-A-52-8828, JP-A-57-82834, U.S. Pat. No. 3,311,476 and JP-B-47-44805 (U.S. Pat. No. 3,615,617), the blocking groups which release a photographically useful reagent by means of a reverse Michael reaction disclosed in JP-B-55-17369 (U.S. Pat. No. 3,888,677), JP-B-55-9696 (U.S. Pat. No. 3,791,830), JP-B-55-34927 (U.S. Pat. No. 4,009,029), JP-A-56-77842 (U.S. Pat. No. 4,307,175), JP-A-59-105642 and JP-A-59-105640, the blocking groups which release a photographically useful reagent with the formation of a quinonemethide or a quinonemethide-like compound by means of intramolecular electron transfer disclosed in JP-B-54-39727, U.S. Pat. Nos. 3,674,478, 3,932,480 and 3,993,661, JP-A-57-135944, JP-A-57-135945 and JP-A-57-136640, those in which an intramolecular ring closing reaction is used, disclosed in JP-A-55-53330 and JP-A-59-218439, those in which the ring opening of a five or six membered ring is used, disclosed in JP-A-76541 (U.S. Pat. No. 4,335,200), JP-A-57-135949, JP-A-57-179842, JP-A-59-137945, JP-A-59-140445, JP-A-59-219741 and JP-A-60-41034, the blocking groups which release photographically useful reagents by means of a Michael reaction disclosed in JP-A-59-201057, JP-A-61-43739, JP-A-61-95346 and JP-A-61-95347, and the blocking groups which release a photographically useful reagent as the development reaction of the silver halide proceeds, as disclosed in JP-A-60-233648, JP-A-61-156043 and JP-A-61-236549. (The term "JP-A" as used herein means an "unexamined published Japanese patent application", and the term "JP-B" as used herein means an "examined Japanese patent publication".)

However, the photographically useful reagents which have been blocked with these known blocking groups are either stable under storage conditions but have a photographic reagent release rate which is too low and require highly alkaline conditions of pH 12 or above, or they deteriorate gradually under storage conditions when the release rate in processing baths of pH 9 to 11 is satisfactory and lose their function as precursors, and since it is not possible to control the photographic reagent release rate to any extent there is a disadvantage in that the pH range which can be used is limited.

SUMMARY OF THE INVENTION

An object of the present invention is to provide photographic reagent precursors which are completely stable during storage and which release the photographic reagent with the required timing during processing.

An other object of the invention is to provide photographic reagent precursors which function over a wide pH range.

It has now been found that these and other object of the invention realized by a silver halide photographic material composed of a support having thereon at least one silver halide photosensitive emulsion layer, at least one layer of the material containing a blocked photographic reagent precursor represented by formula (I):

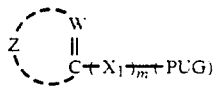

(I)

wherein $X_1$ represents a divalent linking group containing a hetero atom bonded to the carbon atom, provided that $X_1$ is linked to the carbon atom by a group other than

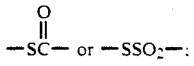

PUG represents a photographically useful group containing a hetero atom bonded to $X_1$; W represents =N— or

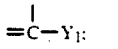

$Y_1$ represents hydrogen or a group capable of being substituted; Z represents an atomic group necessary for forming a heterocyclic ring, provided that when W represents a

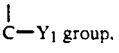

the group adjacent to W in the heterocyclic ring is a group other than

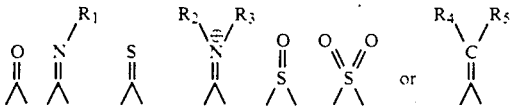

wherein $R_1$, $R_2$, $R_3$, $R_4$ and $R_5$ each represents hydrogen or a group capable of being substituted; and m is 0 or 1, with proviso that when m is 0, the photographically useful group represented by PUG is bonded to a carbon atom via heteroatom of PUG.

DETAILED DESCRIPTION OF THE INVENTION

Blocked photographic reagents represented by formula (I) are not described in detail.

The photographic reagents represented by PUG are any reagents which are conventionally used in silver halide photosensitive materials, and include development inhibitors, anti-fogging agents, development accelerators, nucleating agents, couplers, diffusible and non-diffusible dyes, de-silvering inhibitors, silver halide solvents, competitive compounds, developing agents, auxiliary developing agents, fixing accelerators, fixing inhibitors, image stabilizers, toners, processing dependent improving agents, screen dot improving agents, colored image stabilizers, photographic dyes, surfactants, film hardening agents, desensitizing agents, contrast enhancing agents, chelating agents, fluorescent whiteners and DIR-hydroquinone, etc.

These photographically useful groups often overlap in terms of specific utility and typical examples are described in more specific terms below.

When the PUG is a development inhibitor, it is a known development inhibitor which has a hetero atom and it is bonded via a hetero atom, and examples of these have been described, for example, by C. E. K. Mees and T. H. James on pages 344 to 346 of *The theory of the Photographic Process* (Macmillan, 3rd ed. 1966). In practical terms, these include mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, imidazole, adenines and guanines.

Important specific development inhibitors are listed below, but the present invention is not be construed as being limited thereto.

1. Mercaptotetrazole Derivatives (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole

(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole hydrochloride
(32) 1-(2-Diethylaminoethyl)-5-mercaptotetrazole
(33) 2-(5-Mercapto-1-tetrazolyl)ethyltrimethyl ammonium chloride 2. Mercaptotriazole Derivatives (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 5-(2-Dimethylaminoethyl)-3-mercaptotriazole
(7) 4-(α-Naphthyl)-3-mercaptotriazole 3. Mercaptoimidazole Derivatives (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole 4. Mercaptopyrimidine Derivatives (1) Thiouracil
(2) Methylthiouracil
(3) Ethylthiouracil
(4) Propylthiouracil
(5) Nonylthiouracil
(6) Aminothiouracil
(7) Hydroxythiouracil 5. Mercaptobenzimidazole Derivatives (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthimidazole
(8) 2-Mercapto-5-sulfobenzimidazole
(9) 1-(2-Hydroxyethyl)-2-mercaptobenzimidazole
(10) 5-Caproamido-2-mercaptobenzimidazole
(11) 5-(2-Ethylhexanoylamino)-2-mercaptobenzimidazole 6. Mercaptothiadiazole Derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole 7. Mercaptobenzothiazole Derivatives (1) 2-Mercaptobenzothiazole
(2) 5-Nitro-2-mercaptobenzothiazole
(3) 5-Carboxy-2-mercaptobenzothiazole 8. Mercaptobenzoxazole Derivatives (1) 2-Mercaptobenzoxazole
(2) 5-Nitro-2-mercaptobenzoxazole
(3) 5-Carboxy-2-mercaptobenzoxazole 9. Benzotriazole Derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole, sodium salt
(13) 5-Methoxycarbonylbenzotriazole
(14) 5-Aminobenzotriazole
(15) 5-Butoxybenzotriazole
(16) 5-Ureidobenzotriazole
(17) Benzotriazole 10. Benzimidazole Derivatives (1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole 11. Indazole Derivatives (1) Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole Examples of cases in which PUG is a dye include the compounds disclosed on pages 197 to 211 of "High Function Photochemicals, Structure, Function and Preferred Application" (C.M.C, 1986).

Typical photographically useful dyes include arylidene based dyes, styryl based dyes, butadiene based dyes, oxonol based dyes, cyanine based dyes, merocyanine based dyes, hemi-cyanine based dyes, diarylmethane based dyes, triarylmethane based dyes, azomethine based dyes, azo based dyes, anthraquinone based dyes, stilbene based dyes, chalcone based dyes, indophenol based dyes, indoaniline based dyes, coumarin based dyes, alizarin, nitro based dyes, quinoline based dyes, indigo based dyes and phthalocyanine based dyes. Dye precursors include the leuco forms of these dyes, dyes in which the absorption wavelength has been temporarily shifted, and tetrazolium salts. These dyes can also take the form of chelate dyes with suitable metals. These dyes, are described, for example, in U.S. Pat. Nos. 3,880,658, 3,931,144, 3,932,380, 3,932,381 and 3,942,987.
Important specific dyes are indicated below, but the present invention is not to be construed as being limited thereto.
D-1
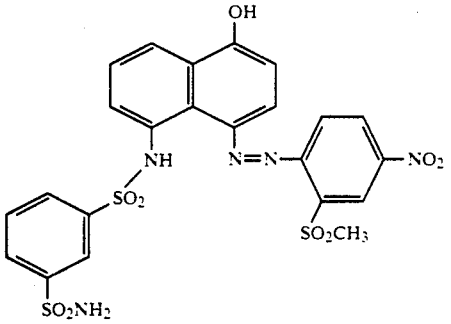
D-2
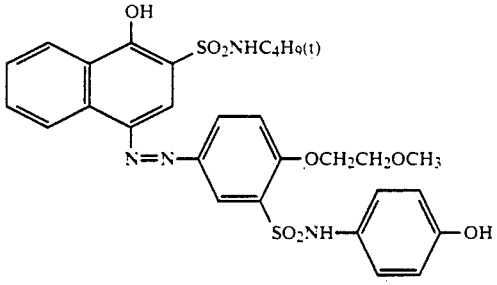
D-3
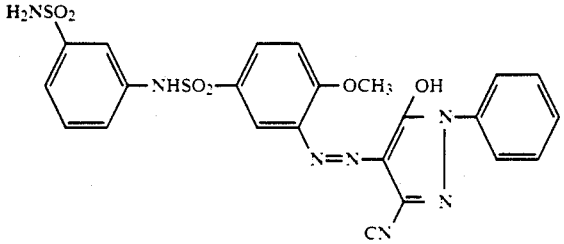
D-4
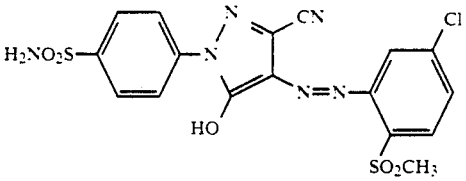
D-5
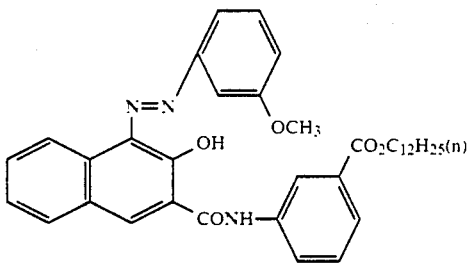
D-6
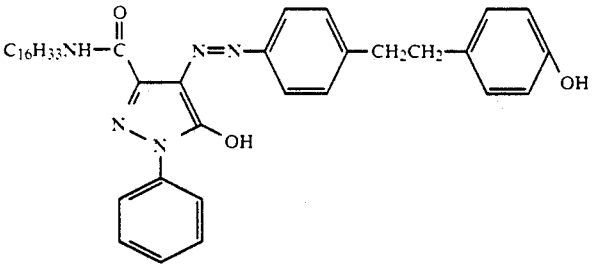
D-7
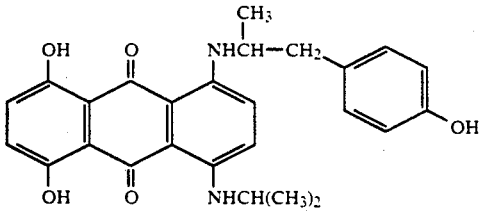
D-8
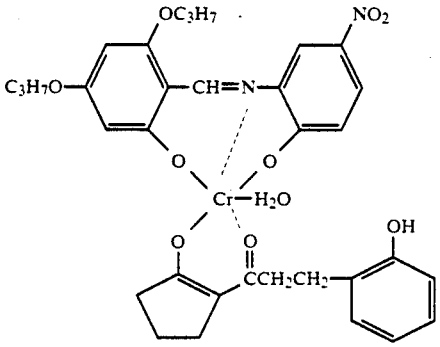

-continued
D-9
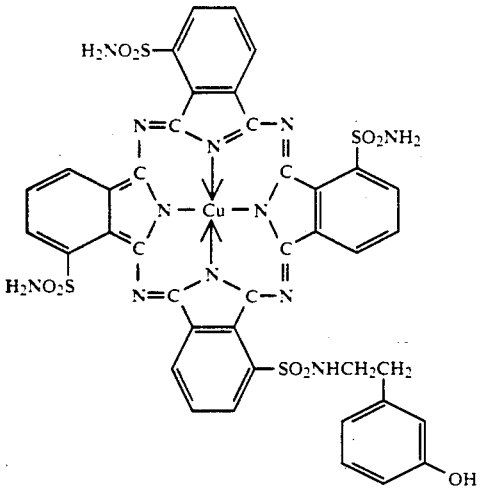
D-10
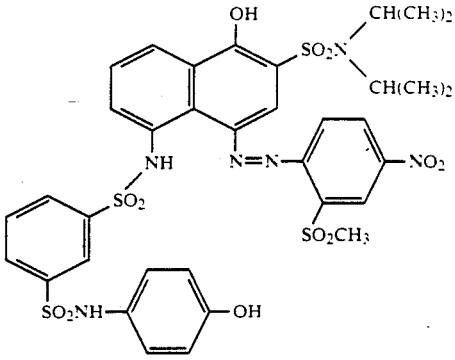
D-11
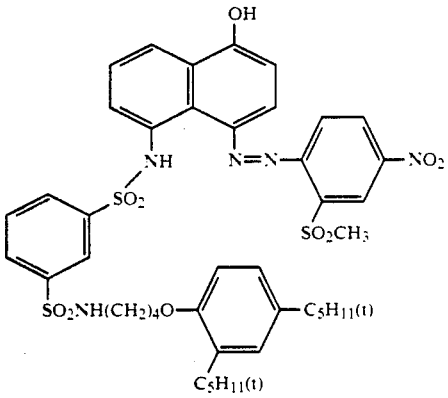
D-12
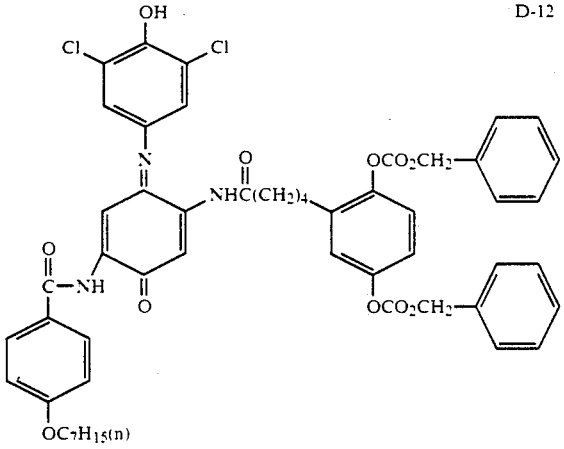
D-13
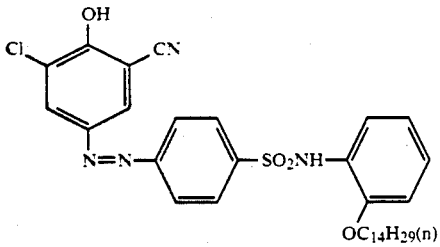
D-14
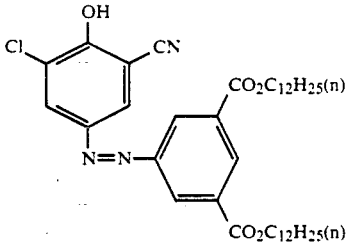
D-15
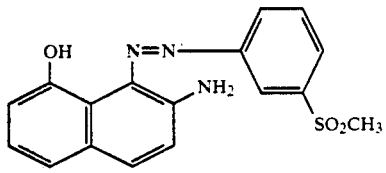
D-16
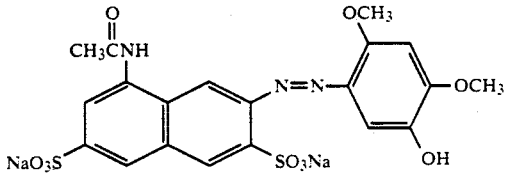

-continued
D-17
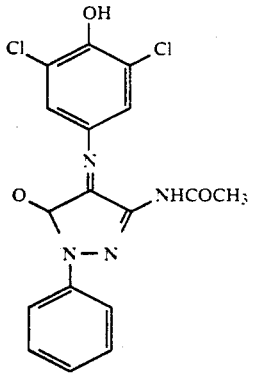
D-18
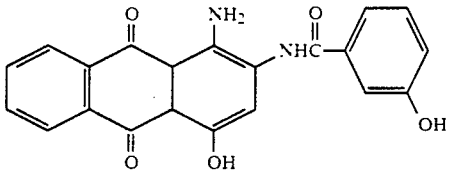
D-19
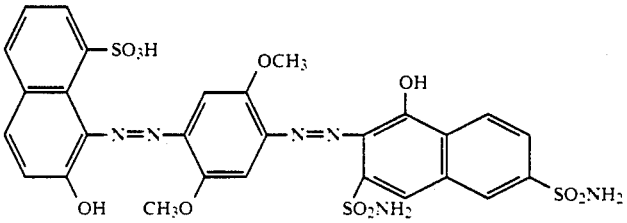
D-20
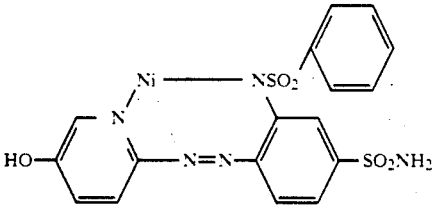
D-21
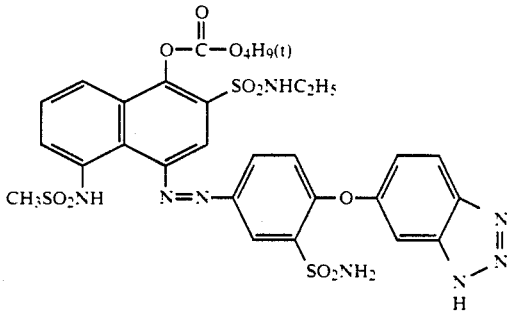
D-22
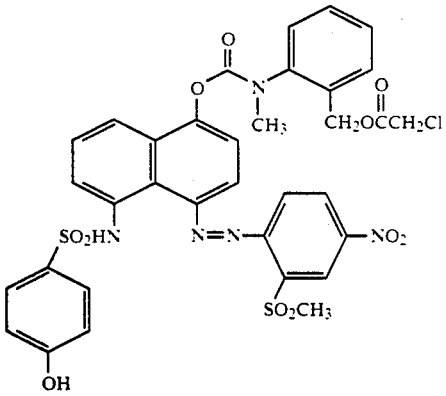
D-23
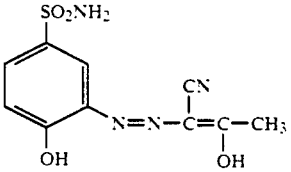
D-24
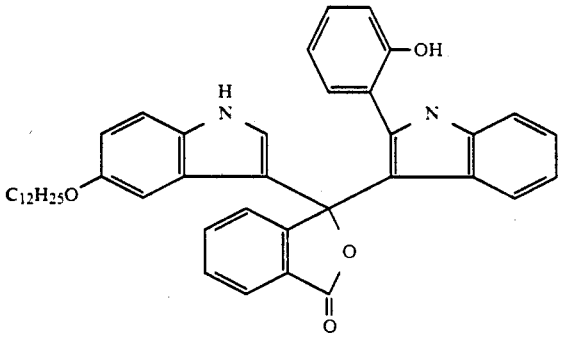
D-25
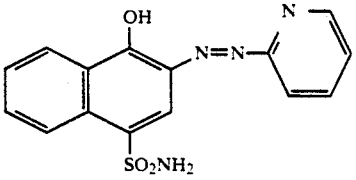

-continued
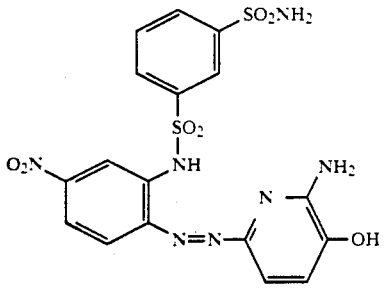
D-26
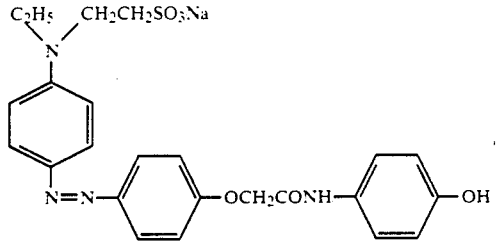
D-27
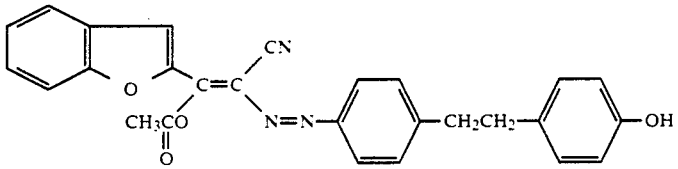
D-28
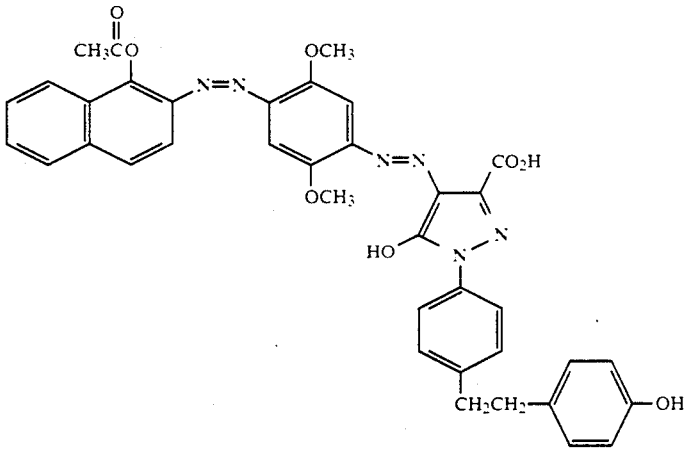
D-29
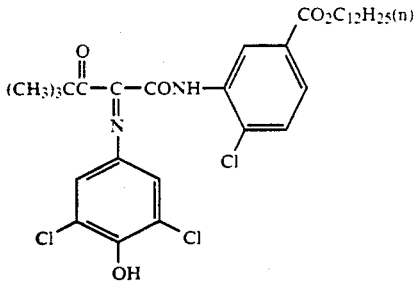
D-30
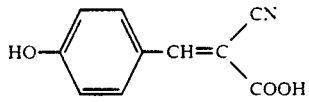
D-31
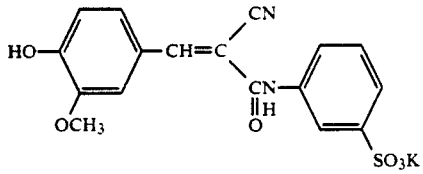
D-32
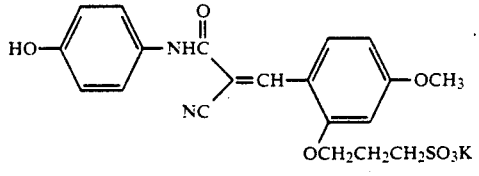
D-33
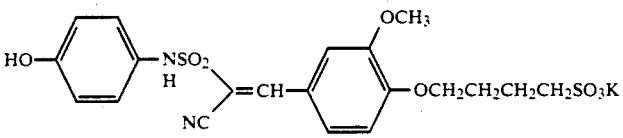
D-34

-continued

D-35

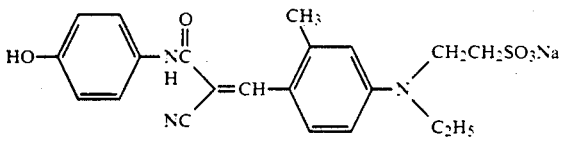

D-36

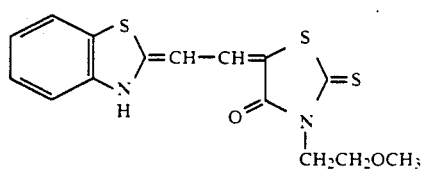

D-37

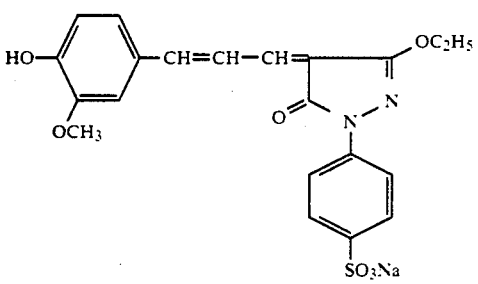

D-38

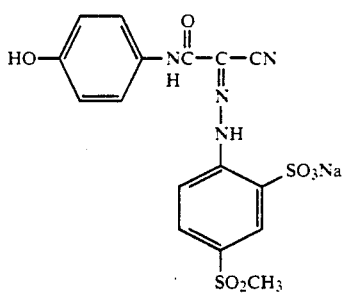

D-39

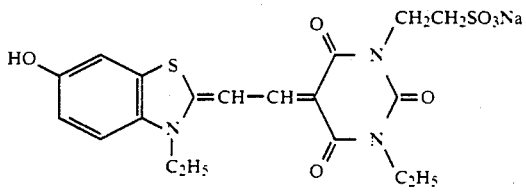

D-40

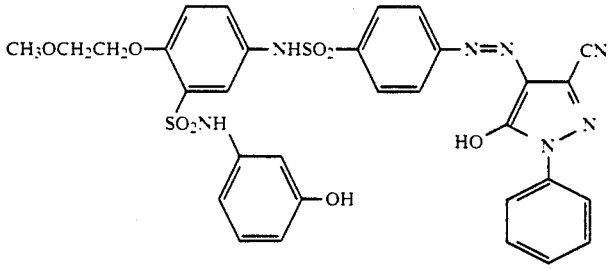

The dyes disclosed in JP-A-59-201057, JP-A-61-95346 and JP-A-61-95347 can also be used as well as the PUG dyes indicated above.

Examples of cases in which the PUG is a silver halide solvent include the mercapto compounds disclosed, for example, in JP-A-60-163042 and U.S. Pat. Nos. 4,003,910 and 4,378,424, and the azolethiones and mercaptozoles which have an amino group as a substituent disclosed, for example, in JP-A-57-202531, and particularly in JP-A-61-230135.

Examples of cases in which the PUG is a nucleating agent include the leaving groups which are released from the couplers disclosed in JP-A-59-170840.

Examples of cases in which the PUG is a developing agent or an auxiliary developing agent include hydroquinones, catechols, aminophenols, p-phenylenediamines, pyrazolidones and ascorbic acid.

Furthermore, photographic reagents which release these photographic reagents by a redox reaction, for example, dyes for color diffusion transfer sensitive materials or DIR hydroquinones, in accordance with the silver halide development reaction as PUG's are also useful photographic reagents.

Other PUG's are disclosed, for example, in JP-A-61-230135 and U.S. Pat. No. 4,248,962.

The photographic reagents described above may be bonded, via a hetero atom, either directly (when m=0) or via $X_1$ (when m=1).

$X_1$ represents a divalent linking group which is bonded via a hetero atom, and it represents a group which releases the PUG rapidly after cleavage as $X_1$-PUG during processing.

Linking groups of this type include those which release the PUG by means of an intramolecular ring closing reaction disclosed in JP-A-54-145135 (British Patent Application 2,010,818A), those which release the PUG by means of an intramolecular electron transfer disclosed, for example, in the specifications of British Patent 2,072,363 and JP-A-57-154234, those which release the PUG along with the elimination of carbon dioxide disclosed, for example, in JP-A-57-179842, and those which release the PUG along with the elimination of formalin disclosed in JP-A-59-93422. The structural formulae of typical $X_1$ groups are shown, together with the PUG groups, below, by the present invention is not to be construed as being limited thereto.

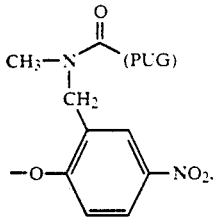

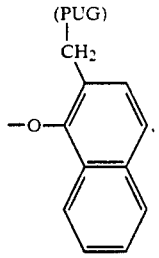

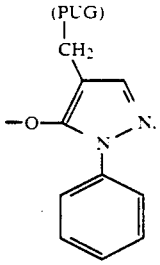

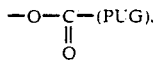

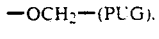

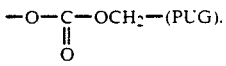

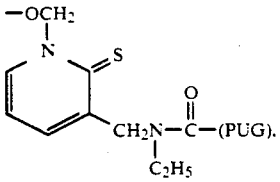

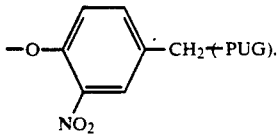

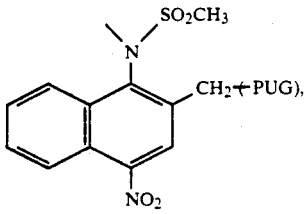

-continued

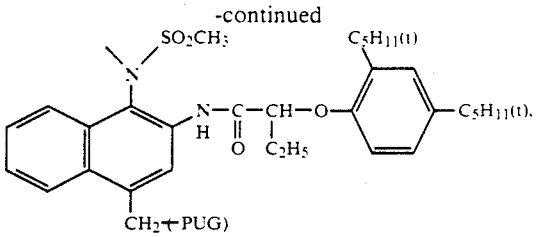

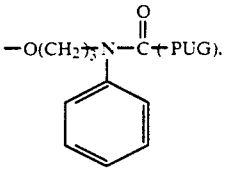

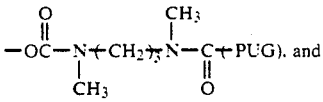

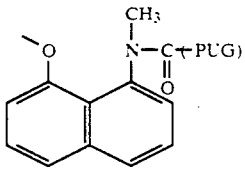

Any of these can be used for $X_1$, being selected in accordance with the time of release of the PUG, control of the release of the PUG, and the type of PUG which is being used.

The group represented by $Y_1$ is now described in detail.

$Y_1$ represents hydrogen, a halogen atom (for example, fluorine, chlorine, bromine), an alkyl group (which preferably has from 1 to 20 carbon atoms), an aryl group (which preferably has from 6 to 20 carbon atoms), an alkoxy group (which preferably has from 1 to 20 carbon atoms), an aryloxy group (which preferably has from 6 to 20 carbon atoms), an acyloxy group (which preferably has from 2 to 20 carbon atoms), an amino group (unsubstituted amino or, preferably, a secondary or tertiary amino group substituted with an alkyl group which has from 1 to 20 carbon atoms or an aryl group which has from 6 to 20 carbon atoms), a carbonamido group (preferably an alkylcarbonamido group which has from 1 to 20 carbon atoms or an arylcarbonamido group which has from 6 to 20 carbon atoms), a ureido group (preferably an alkylureido group which has from 1 to 20 carbon atoms or an arylureido group which has from 6 to 20 carbon atoms), a carboxyl group, a carboxylic acid ester group (preferably an alkyl carboxylic acid ester group which has from 1 to 20 carbon atoms or an aryl carboxylic acid ester group which has from 6 to 20 carbon atoms), an oxycarbonyl group (preferably an alkyloxycarbonyl group which has from 1 to 20 carbon atoms or an aryloxycarbonyl group which has from 6 to 20 carbon atoms), a carbamoyl group (preferably an alkylcarbamoyl group which has from 1 to 20 carbon atoms or an arylcarbamoyl group which has from 6 to 20 carbon atoms), an acyl group (preferably an alkylcarbonyl group which has from 1 to 20 carbon atoms or an arylcarbonyl group which has from 6 to 20 carbon atoms), a sulfo group, a sulfonyl group (preferably an alkylsulfonyl group which has from 1 to 20 carbon atoms or an arylsulfonyl group which has from 6 to 20 carbon atoms), a sulfamoyl group (preferably an alkylsulfamoyl group which has from 1 to 20 carbon atoms or an arylsulfamoyl group which has from 6 to 20 carbon atoms), a cyano group or a nitro group. The above mentioned alkyl groups, alkenyl groups and aryl groups also include those groups which are further substituted with the various substituent groups aforementioned.

Moreover, $Y_1$ is selected in accordance with the pH of the processing liquid which is used to process the photographic element which contains the photographic reagent precursor of this invention and the timing which is required. For example, an electron donating group typified by an alkyl group or an alkoxy group is selected when processing is to be carried out using a processing liquid of high pH and delay timing is required. Conversely, when processing is to be carried out in a processing liquid of low pH in the 9 to 11 range, or when rapid timing is required, an electron withdrawing group typified by the halogen atoms, acyl groups, sulfonyl groups, or the nitro group, for example, can be selected for $Y_1$ in order to achieve the prescribed objective. Thus, it is possible to control the release rate over a very wide range by the appropriate selection of $Y_1$ in this way.

The ring which is formed by Z is a five, six or seven membered heterocyclic ring which contains at least one nitrogen atom, oxygen atom and/or sulfur atom, and these include those in which the heterocyclic ring is formed with a condensed ring in a appropriate position.

However, when W is a $$=\overset{|}{C}-Y_1 \text{ group,}$$

in the group of atoms forming the heterocyclic ring, the substituent in the position adjoining W excludes the following groups:

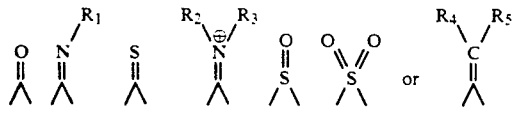

(where $R_1$, $R_2$, $R_3$, $R_4$ and $R_5$, each which may be the same a different represents hydrogen or groups capable of being substituted). The heterocyclic ring is preferably a nitrogen containing heterocyclic ring.

Specific examples include imidazoline, thiazoline, oxazoline, pyrrole, oxazole, thiazole, imidazole, triazole, tetrazole, pyridine, pyrimidine, pyrazine, pyridazine and triazine. Rings in which a condensed ring is formed in an appropriate position on these heterocyclic rings, include quinoline, isoquinoline, phthalazine, quinazoline, quinoxaline, benzothiazole, benzoxazole, benzimidazole, naphthylidine, thiazolo[4,5-d]pyrimidine, 4H-pyrido[1,2-a]pyrimidine, imidazo[1,2-a]pyridine, pyrrolo[1,2-a]pyrimidine, 1H-pyrrolo[ 2,3-b]pyridine, 1H-pyrrolo[3,2-b]pyridine, 6H-pyrrolo[3,4-b]pyridine, benzoimidazole, triazoles (for example, pyrido[3,4-d]pyridazine, pyrido[3,4-d]pyrimidine, imidazo[1,5-a]pyrimidine, pyrazolo[1,5-a]pyrimidine, 1H-imidazo[4,5-b]pyridine, 7H-pyrrolo[2,3-d]pyrimidine), tetra-azaindenes (for example, pteridine, 4H-imidazo[1,2-b][1,2,4]triazole, indazo[4,5-d]imidazole, 1H-1,2,4-triazolo[4,3-b]pyridazine, 1,2,4-triazolo[1,5-a]pyrimidine, imidazo[1,2-a]-1,3,5-triazine, pyrazolo[1,5-a]-1,3,5-triazine, 7H-purine, 9H-purine, 1H-pyrazolo[3,4-d]pyrimidine), and pentaazaindenes (for example, [1,2,4]triazolo[1,5-a][1,3,5]triazine, 1,2,4-triazolo[3,4-f][1,2,4]triazine and 1H-1,2,3-triazolo[4,5-d]pyrimidine).

These heterocyclic rings may have one or more or of the substituent groups indicated below, and when there are two or more substituents they may be the same or different.

Specific examples of substituent groups include halogen atoms (for example, fluorine, chlorine, bromine), alkyl groups (which preferably have from 1 to 20 carbon atoms), aryl groups (which preferably have from 6 to 20 carbon atoms), alkoxy groups (which preferably have from 1 to 20 carbon atoms), aryloxy groups (which preferably have from 6 to 20 carbon atoms), alkylthio groups (which preferably have from 1 to 20 carbon atoms), arylthio groups (which preferably have from 6 to 20 carbon atoms), acyl groups (which preferably have from 2 to 20 carbon atoms), acylamino groups (preferably alkanoylamino groups which have from 1 to 20 carbon atoms or benzoylamino groups which have from 6 to 20 carbon atoms), nitro groups, cyano groups, oxycarbonyl groups (preferably alkoxycarbonyl groups which have from 1 to 20 carbon atoms or aryloxycarbonyl groups which have from 6 to 20 carbon atoms), hydroxyl groups, sulfoxy groups, sulfo groups, ureido groups (preferably alkylureido groups which have from 1 to 20 carbon atoms or arylureido groups which have from 6 to 20 carbon atoms), sulfonamido groups (preferably alkylsulfonamido groups which have from 1 to 20 carbon atoms or arylsulfonamido groups which have from 6 to 20 carbon atoms), sulfamoyl groups (preferably alkylsulfamoyl groups which have from 1 to 20 carbon atoms or arylsulfamoyl groups which have from 6 to 20 carbon atoms), carbamoyl groups (preferably alkylcarbamoyl groups which have from 1 to 20 carbon atoms or arylcarbamoyl groups which have from 6 to 20 carbon atoms), acyloxy groups (which preferably have from 1 to 20 carbon atoms), amino groups (unsubstituted amino groups, and preferably secondary or tertiary amines substituted with alkyl groups which have from 1 to 20 carbon atoms or aryl groups which have from 6 to 20 carbon atoms), carboxylic acid ester groups (preferably alkyl carboxylic acid ester groups which have from 1 to 20 carbon atoms or aryl carboxylic acid ester groups which have from 6 to 20 carbon atoms), sulfone groups (preferably alkylsulfone groups which have from 1 to 20 carbon atoms or arylsulfone groups which have from 6 to 20 carbon atoms) and sulfinyl groups (preferably alkyl sulfinyl groups which have from 1 to 20 carbon atoms and arylsulfinyl groups which have from 6 to 20 carbon atoms).

The ring formed by Z is preferably a nitrogen containing aromatic heterocyclic ring, and the following are especially preferred: Pyridine, pyrimidine, pyrazine, triazine, quinoline, quinazoline, quinoxaline, tri-azaindenes, tetra-azaindenes and penta-azaindenes. Of these, the triazaindenes, the tetraazaindenes and the penta-azaindenes are most preferred.

Specific examples of useful blocked photographic reagents of this invention are indicated below, but the invention is not to be construed as being limited to these examples.

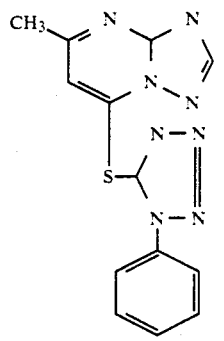
(1)

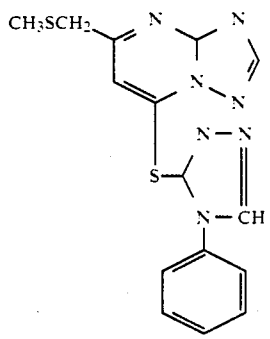
(2)

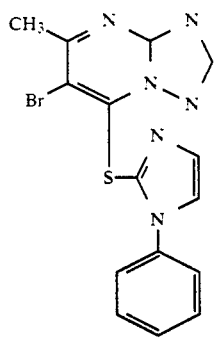
(3)

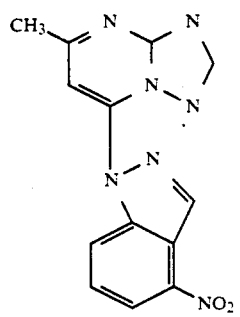
(4)

-continued
(5)
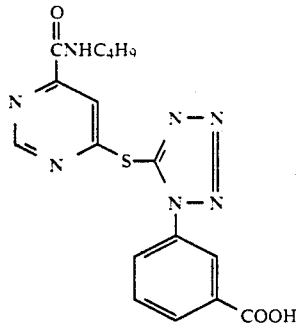
(6)
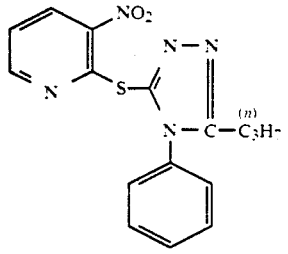
(7)
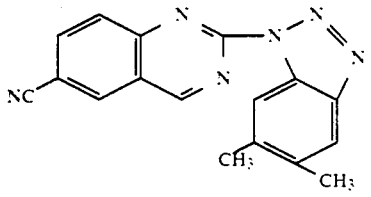
(8)
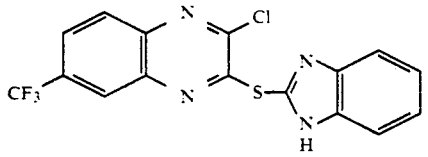
(9)
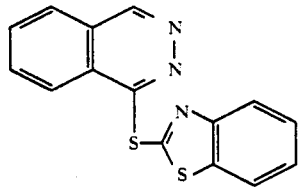
(10)
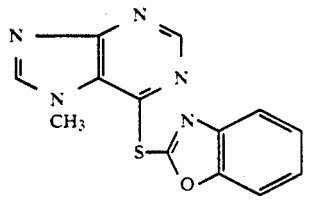

-continued
(11)
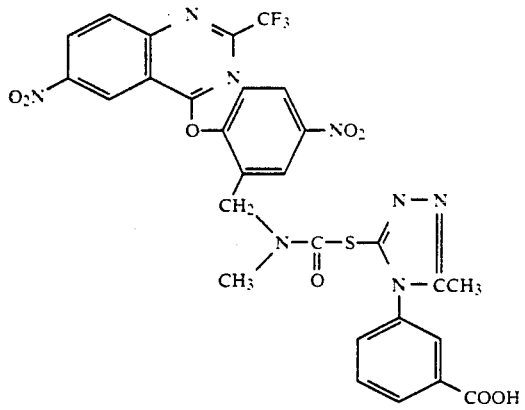
(12)
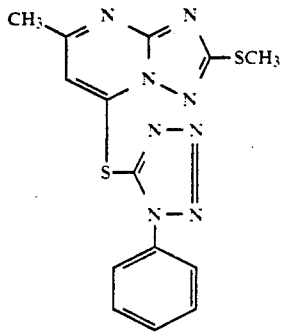
(13)
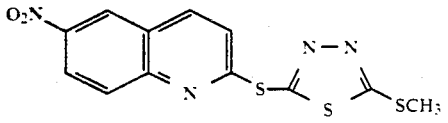
(14)
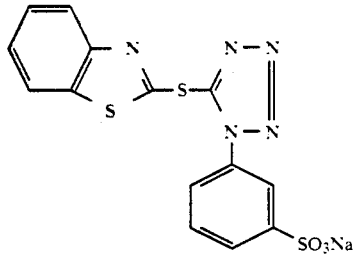
(15)
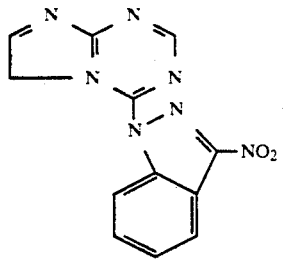
(16)
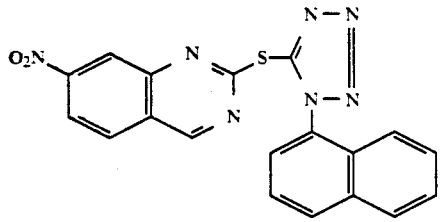

-continued
(17)
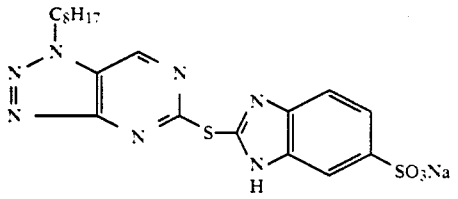
(18)
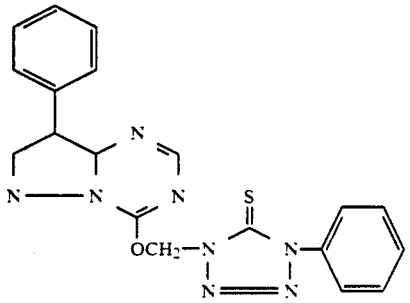
(19)
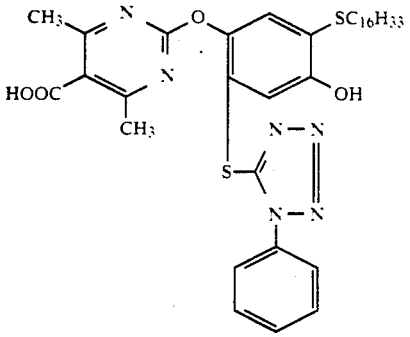
(20)
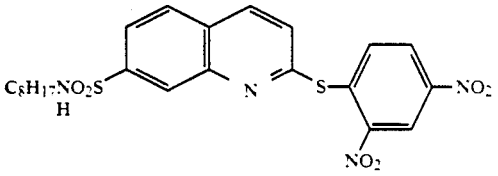
(21)
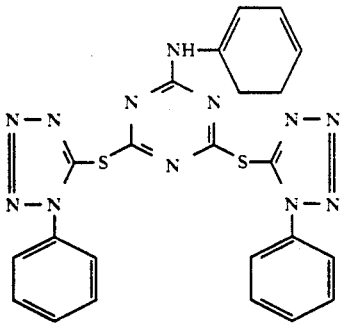
(22)
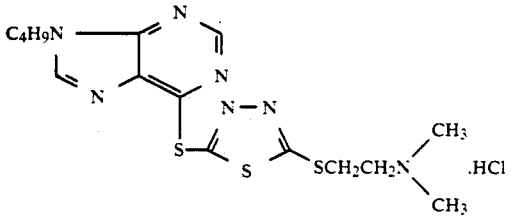

-continued
(23)
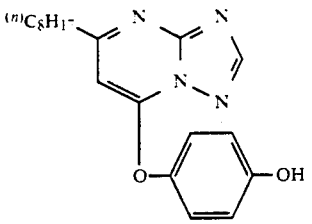
(24)
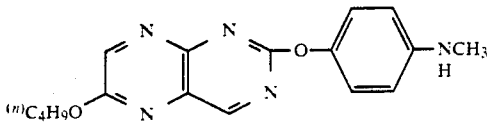
(25)
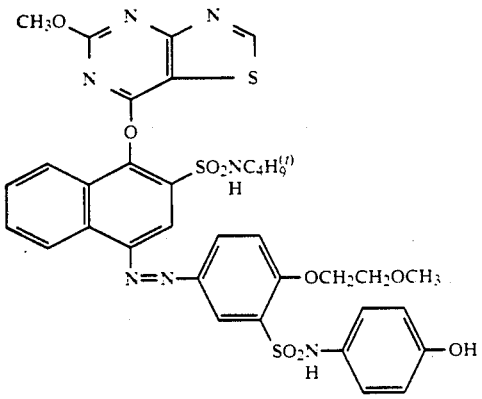
(26)
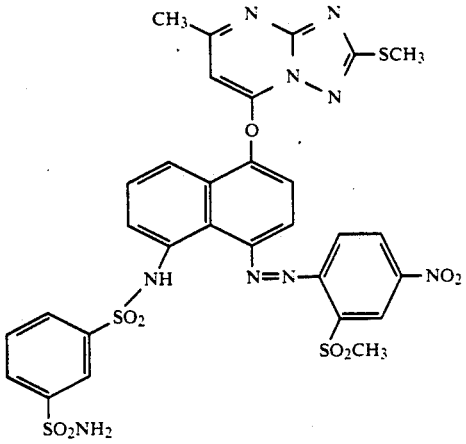

-continued
(27)
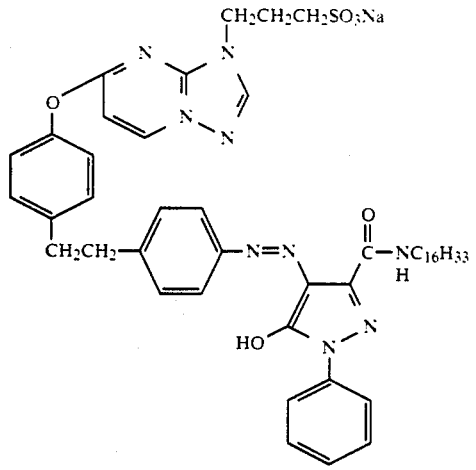
(28)
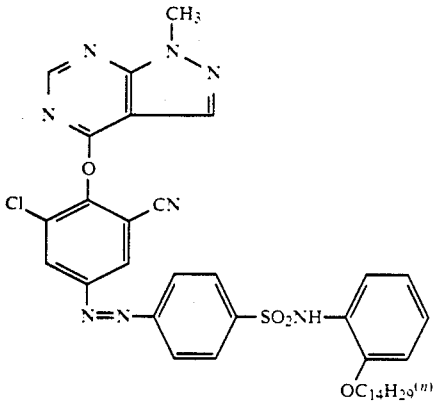
(29)
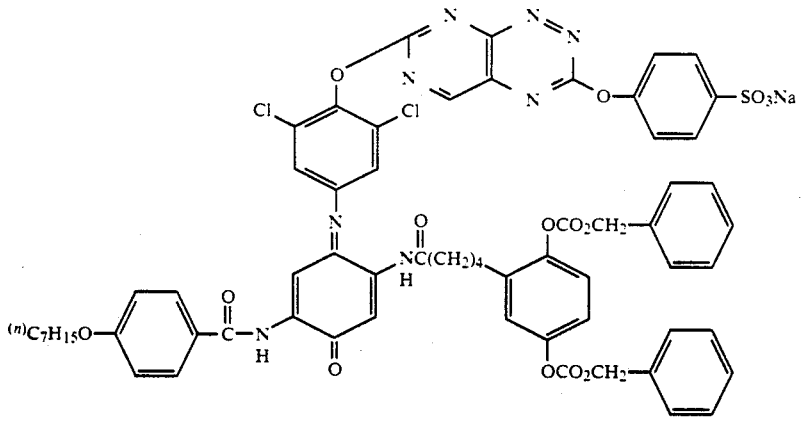

-continued
(30)
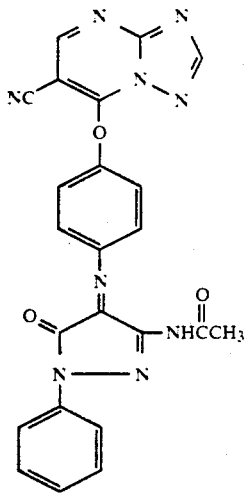
(31)
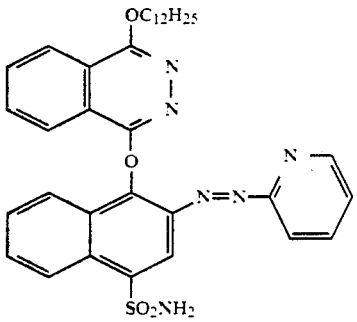
(32)
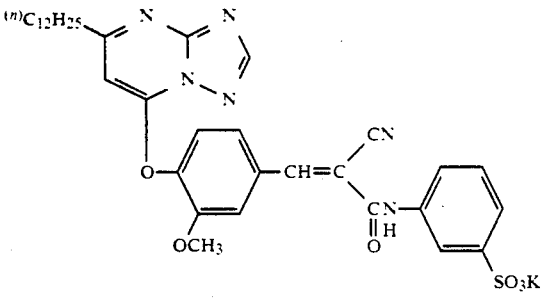
(33)
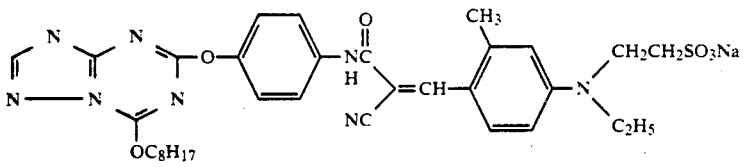
(34)
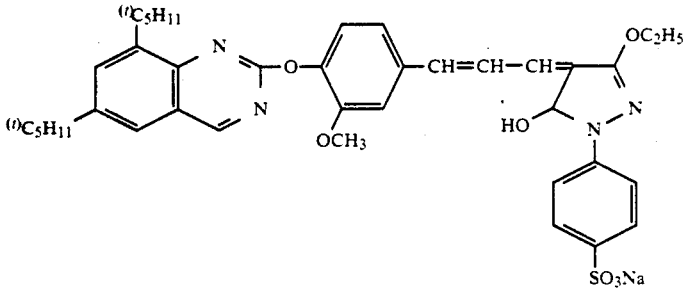

-continued
(35)
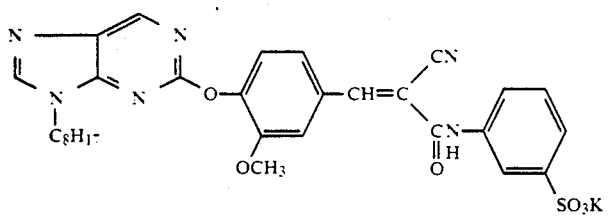
(36)
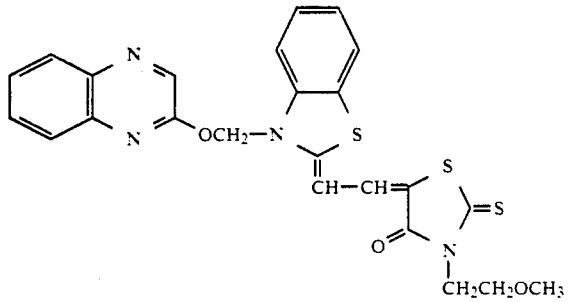
(37)
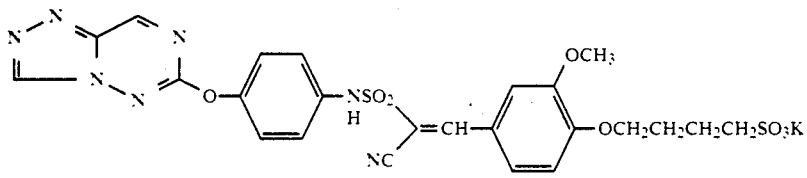
(38)
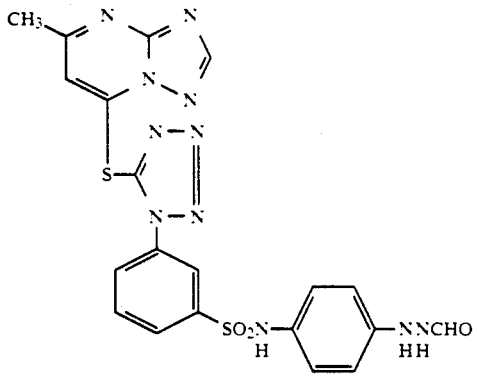
(39)
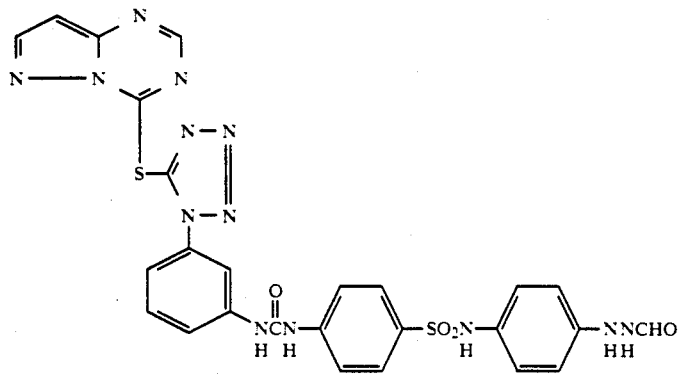

-continued
(40)
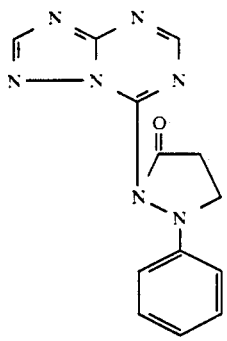
(41)
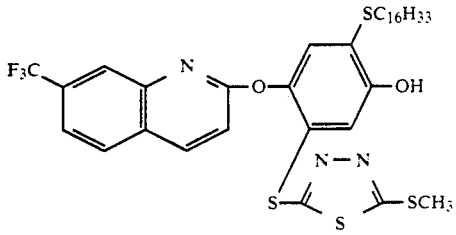
(42)
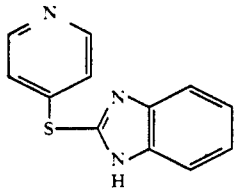
(43)
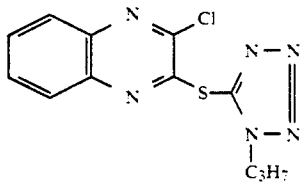
(44)
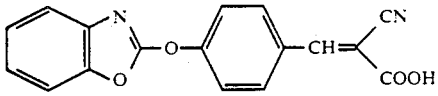
(45)
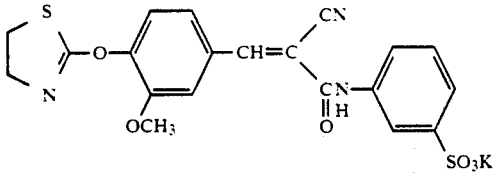
(46)
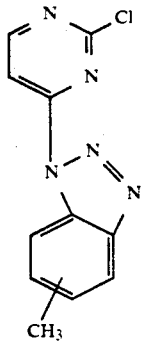

-continued
(47)
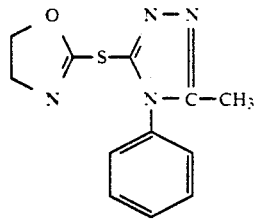
(49)
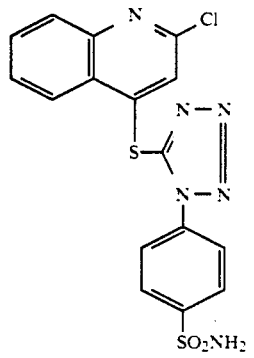
(50)
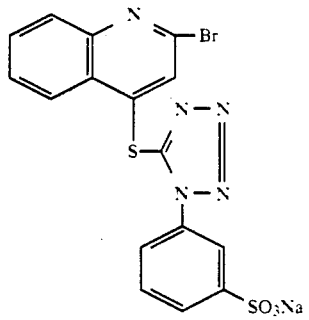
(51)
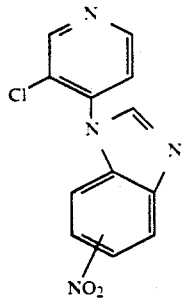
(52)
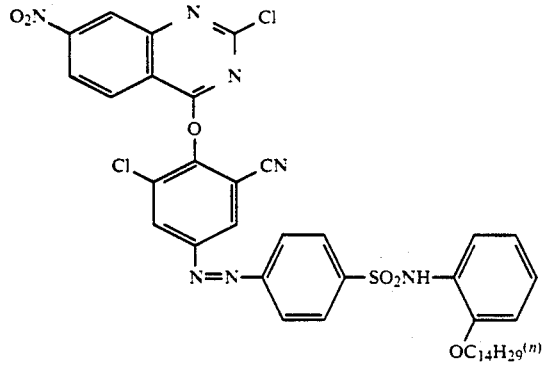

-continued
(53)
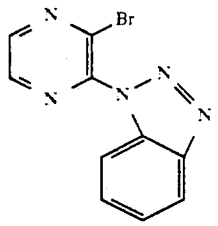
(54)
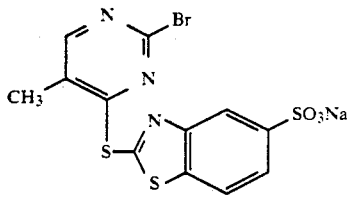
(55)
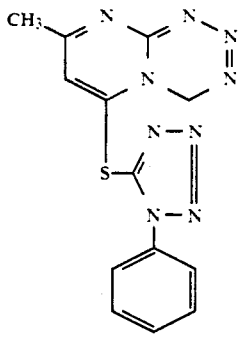
(56)
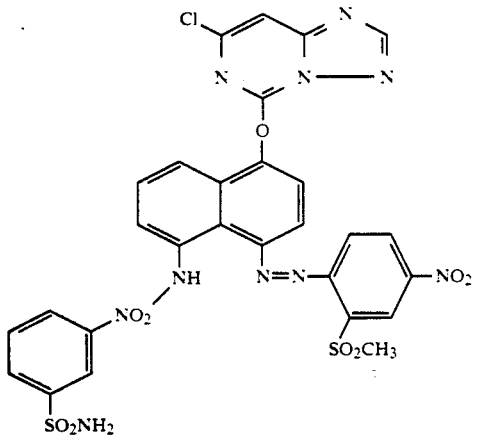
(57)
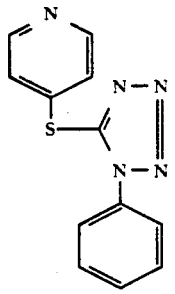

-continued (58)

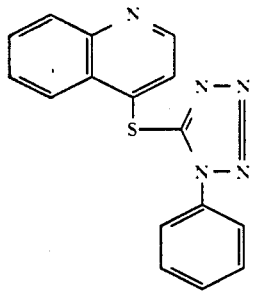

(59)

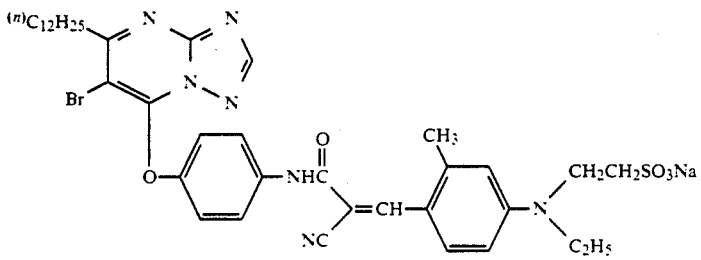

Examples of the synthesis of typical blocked photographic reagents of this invention are indicated below.

SYNTHESIS EXAMPLE 1

Synthesis of Illustrative Compound (1)

The synthesis of the 1,2,4-triazolo[1,5-a]-pyrimidines used in the invention can be achieved easily with reference to the methods described, for example, in *The Journal of Organic Chemistry*, 24, 779 to 801 (1959) and 361 to 366 (1960).

Triethylamine (3.8 ml) was added dropwise at room temperature under a nitrogen stream to a solution consisting of 20 ml of acetonitrile and 4 grams of 5-mercapto-1-phenyltetrazole. After stirring the mixture for 5 minutes, a solution consisting of 10 ml of acetonitrile and 3.8 grams of 7-chloro-5-methyl-1,2,4-triazolo[1,5-a]pyrimidine which had been prepare using the method described above was added dropwise with ice cooling. The mixture was then returned to room temperature and stirred for 2 hours, after which the reaction mixture was filtered. The filtrate was concentrated and dried under reduced pressure, after which it was extracted with the addition of 100 ml of chloroform and 50 ml of water. The chloroform layer was dried over magnesium sulfate and then the chloroform was removed under reduced pressure. The concentrated residue was refined using alumina chromatography, whereupon 5.5 grams of illustrative compound (1) was obtained in the form of a highly viscous oil.

SYNTHESIS EXAMPLE 2

Synthesis of Illustrative Compound (4)

Five ml of acetonitrile and 0.6 ml of 1,8-diazabicyclo[5,4,0]undecene-7 (DBU) were added dropwise at room temperature to a solution consisting of 50 ml of acetonitrile and 1.9 grams of 5-nitroindazole and, after stirring the mixture for 5 minutes, a solution consisting of 10 ml of acetonitrile and 2 grams of 7-chloro-5-methyl-1,2,4-triazolo[1,5-a]pyrimidine was added dropwise. The crystals which precipitated out after stirring the mixture at room temperature for 1 hour were recovered by filtration. The crystals obtained were recrystallized from acetonitrile, whereupon 3.1 grams of the illustrative compound (4) was obtained in the form of white crystals having m.p. of not lower than 250° C.

SYNTHESIS EXAMPLE 3

Synthesis of Illustrative Compound (13)

The synthesis of 2-chloroquinolines can be achieved easily with reference to the method described in the *Journal of the American Chemical Society*, 80, 1421 (1958).

Two ml of triethanolamine was added dropwise at room temperature under a nitrogen stream to a solution consisting of 15 ml of acetonitrile and 2 grams of 5-methylthio-2-mercapto-1,3,4-thiadiazole. After stirring for 5 minutes, a solution consisting of 10 ml of acetonitrile and 2.5 grams of 2-chloro-6-nitroquinoline was added dropwise with ice cooling. After returning to room temperature, the mixture was stirred for 1 hour and the reaction mixture was filtered. The filtrate was concentrated and dried under reduced pressure and then extracted (twice) with the addition of 100 ml of chloroform and 50 ml of water. The chloroform layers were combined and dried over magnesium sulfate, after which the chloroform was removed under reduced pressure and the concentrated residue was refined using alumina chromatography, whereupon 3.8 grams of illustrative compound (13) was obtained in the form of pale yellow crystals having m.p. of 187° to 190° C.

SYNTHESIS EXAMPLE 4

Synthesis of Illustrative Compound (22)

The synthesis of purines can be achieved easily with reference to the method described in the *Journal of Organic Chemistry*, 24, 1214 (1959).

Twenty eight percent sodium methoxide (4.1 grams) was added dropwise at room temperature under a nitrogen stream to a solution consisting of 10 ml of methanol and 4 grams of 5-(N,N-dimethylethyl)thio-2-mercapto-1,3,4-thiadiazole and, after stirring the mixture for 10 minutes at room temperature, the methanol was removed under reduced pressure. A solution obtained by dissolving the residue in 20 ml of acetonitrile was added dropwise with ice cooling under a nitrogen stream to a solution consisting of 20 ml of acetonitrile and 4.4 grams of 6-chloro-9-butylpurine. After returning to room temperature the mixture was stirred for 2 hours, after which the reaction mixture was filtered. The filtrate was concentrated under reduced pressure and then 10 ml of ethanol and 4 ml of 30% hydrochloric acid/ethanol solution were added to the residue and, after stirring at room temperature for 5 minutes, the ethanol was removed under reduced pressure. Ethyl acetate was added to the residue so obtained and the crystals which precipitated out were recovered by filtration, whereupon 5.4 grams of illustrative compound (22) was obtained in the form of white crystals having m.p. of 176° to 179° C.

SYNTHESIS EXAMPLE 5

Synthesis of Illustrative Compound (44)

1,8-Diazabicyclo[5,5,0]undecene-7 (DBU) (5.4 ml) was added dropwise at room temperature to a solution consisting of 20 ml of acetonitrile and 5 grams of the dye D-31. After stirring for 5 minutes, 3 ml of 2-chlorobenzoxazole was added dropwise with ice cooling. After returning to room temperature and stirring the mixture for 1 hour the reaction mixture was concentrated and dried under reduced pressure. The residue was extracted (three times) with the addition of 100 ml of chloroform and 30 ml of 10% aqueous hydrochloric acid. The chloroform layers were combined and dried over magnesium chloride, after which the chloroform was removed under reduced pressure. Ethyl acetate/n-hexane was added to the residue and the crystals which formed were recovered by filtration, whereupon 4.2 grams of illustrative compound (44) was obtained in the form of pale yellow crystals having m.p. of 210° to 212° C.

SYNTHESIS EXAMPLE 6

Synthesis of Illustrative Compound (46)

1,8-Diazabicyclo[5,4,0]undecene-7 (2.2 ml) was added dropwise at room temperature to a solution consisting of 10 ml of acetonitrile and 3 grams of 5-methylbenzotriazole. After stirring for 5 minutes, the mixture was cooled to −10° C. and a solution consisting of 3.4 grams of 2,4-dichloropyridine and 10 ml of acetonitrile was added dropwise over a period of 30 minutes, and after stirring the mixture for 1 hour at −10° C., the acetonitrile was removed under reduced pressure. The residue obtained was extracted with the addition of 100 ml of chloroform and 50 ml of water. The chloroform layers were combined and dried over magnesium sulfate, after which the chloroform was removed under reduced pressure. Ethyl acetate was added to the residue and the crystals which precipitated out were recovered by filtration, whereupon 3.7 grams of illustrative compound (46) was obtained in the form of white crystals having m.p. of 196° to 198° C.

The selection of the heterocyclic ring $Y_1$ which is formed by Z, W and a carbon atom, and the substituent groups of the heterocyclic ring, in general formula (I) is made in accordance with the pH and composition of the processing liquid in which the photographic element which contains the compound of general formula (I) of this invention is to be processed and the timing required. The pH of the processing liquid differs in development, bleaching and fixing, but a pH within the range from 3.0 to 13.0 is normally used, and the preferred pH range is from 5.0 to 12.5.

Furthermore, the rate of release of the compounds of this invention can be controlled over a wide range not only by the pH during processing but also by the use of sulfite ion, hydroxylamine, thiosulfate ion, metabisulfite ion, the hydroxamic acid and related compounds disclosed in JP-A-59-198453, the oxime compounds disclosed in JP-A-60-35729 and other nucleophilic substances such as the p-aminophenol based developing agents, 1-phenyl-3-pyrazolidone based developing agents and the dihydroxybenzene based developing agents described in JP-A-62-245252.

The nucleophilic substances may be used either by incorporating in a treating solution such as developing agent, or by previously adding these having larger carbon atoms into a photosensitive material so as to be contacted with the precursor due to individual dispersion in each layers when the photographic material is treated. Under the circumstances, the nucleophilic substances and the precursors are preferably added into different layers, lest these two materials should contact each other in coating process and before treatment of the photosensitive material. Alternatively, a precursor compound of these nucleophilic substances may be used by adding thereof into a photosensitive material.

The layers to which these compounds are added are principally not restricted, with being preferred in an emulsion layer, subbing layer, protective layer, intermediate layer, filter layer, anti-halation layer, coloring layer, image receiveing layer, or cover-sheet.

On the other hand, if nucleophilic substances are used by adding into a treating solution, in a case of combination use with a precursor of fix promoter of fix inhibitor, the substances are preferably added into a solution of post-treating step following the dvelopment, such as fixing bath, and bleach-fixing bath, to effect an advantage of the present invention.

When these nucleophilic substances are incorporated into the photosensitive material, the amount added is of the order of from about 10 to $10^5$ mol, preferably from 10 to $10^3$ mol per mol of the compound of this invention.

On the other hand, when these nucleophilic substances are added in a treating solution, the amount added is of the order of from $10^{-4}$ to 10 mol, preferably from $10^{-2}$ to 10 mol/l of the treating solution.

Two or more types of the precursors used in the invention can be used conjointly.

The blocked photographic reagents (precursors) of this invention may be added to the silver halide emulsion layers, coloring layers, under-layers, protective layers, intermediate layers, filter layers, anti-halation layers, image receiving layers, cover sheet layers, neutralizing layers, neutralizing timing layers, white reflecting layers or any other auxiliary layers of the silver halide photographic material.

The precursors used in the invention can be added to these layers in the state of a precursor, or in the form of a solution of suitable concentration in a solvent, such as water or alcohol, for example, which does not have an adverse effect on the photographic material, to the coating liquid which is used for forming the layer. Furthermore, the precursors can be dissolved in a high boiling point organic solvent and/or a low boiling point organic solvent and added in the form of an emulsified dispersion of this solution in an aqueous solution.

Furthermore, they can be loaded onto a polymer latex and added using the methods disclosed, for example, in JP-A-51-39853, JP-A-51-59942, JP-A-54-32552 and U.S. Pat. No. 4,199,363.

The precursors of this invention can be added at any time during the manufacturing process but, in general, addition immediately prior to coating is preferred.

The preferred amount of a precursor of this invention to be added differs according to the type of photographically useful reagent involved and it is impossible to lay down a general rule, but the appropriate amount for addition can be selected easily by those familiar with the industry according to the type of photographically useful reagent. The amounts in the case of some typical photographically useful reagents are indicated below.

For an anti-foggant or development inhibitor, the amount added is from $10^{-8}$ to $10^{-1}$ mol (and preferably from $10^{-6}$ to $10^{-1}$ mol of mercapto based anti-foggant and from $10^{-5}$ to $10^{-1}$ mol of an azole based anti-foggant such as benzotriazole) per mol of silver. For a developing agent the amount added is from $10^{-2}$ to 10 mol, and preferably from 0.1 to 5 mol, per mol of silver. For an auxiliary developing agent such as a pyrazolidone based auxiliary developing agent the amount added is from $10^{-4}$ to 10 mol, and preferably from $10^{-2}$ to 5 mol, per mol of silver. For a nucleating agent (fogging agent) the amount added is from $10^{-2}$ to $10^{-6}$ mol, and preferably from $10^{-3}$ to $10^{-5}$ mol, per mol of silver. For a silver halide solvent such as hypo the amount added is preferably from $10^{-3}$ to 10 mol, and preferably from $10^{-2}$ to 1 mol, per mol of silver. For photographic dyes the amount added is from $10^{-3}$ to 1 mol, and preferably from $5\times10^{-3}$ to 0.5 mol, per mol of silver.

When the PUG is a photographically useful dye, the dye itself is not able dye the layer to which it is added selectively and essentially it does not leave any residual staining or contamination of the residual coloration, being washed out from the photosensitive material or undergoing a decolorizing reaction during photographic processing (during development, bleaching, fixing, water washing etc.), but by blocking the dye with a blocking group of this invention the layer to which it is added is dyed selectively, and there is essentially no diffusion into the other layers, and this is desirable.

By providing these properties, it is possible to obtain silver halide sensitive materials which are excellent in respect of the adjustment of sensitivity by a light filtering effect and in respect of improved safety in respect of safe-lighting.

The photosensitive materials of this invention can be used as coupler-type color photographic materials. Color photosensitive materials include camera color negative films (general purpose, professional, cine), color reversal films, color printing papers, color reversal printing papers and cinema projection films.

Compounds of this invention can also be used in silver dye bleach systems such as those described, for example, in T. H. James, *The Theory of the Photographic Process*, chapter 12, and *Principles and Chemistry of Color Photography*, IV, Silver Dye Bleach Process, edited by T. H. James, (Macmillan, New York, 4th ed 1977), pages 363 to 366.

The invention can also be applied to black and white photosensitive materials. Black and white photosensitive materials include medical X-ray films, general purpose black and white films, lith films and scanner films.

When the invention is applied to color diffusion transfer photographic materials, these may be peel-apart type materials or unified (integrated) type materials as disclosed in JP-B-46-16356, JP-B-48-33697, JP-A-50-13040 and British Patent 1,330,524, or film units for which peeling apart is unnecessary, such as those disclosed in JP-A-57-119345.

Furthermore, the invention can also be applied to the heat developable photosensitive materials disclosed, for example, in U.S. Pat. No. 4,500,626, JP-A-60-133449, JP-A-59-218443 and JP-A-61-238056.

Any of the silver halides, namely silver chloride, silver bromide, silver iodide or silver chlorobromide, silver chloroiodide, silver iodobromide and silver chloroiodobromide can be used in the invention. The halogen composition may be uniform throughout the grains or the compositions of the interior and surface parts of the grains may be different (JP-A-57-154232, JP-A-58-108533, JP-A-59-48755, JP-A-59-52237, U.S. Pat. No. 4,433,048 and European Patent 100,984). Furthermore, tabular grains of thickness less than 0.5 μm and of diameter at least 0.6 μm which have a mean aspect ratio of at least 5 (for example, U.S. Pat. Nos. 4,414,310 and 4,435,499, and West German Patent (OLS) 3,241,646A1), or mono-disperse emulsions in which the grain size distribution is more or less uniform (for example, JP-A-57-178235, JP-A-58-100846, JP-A-58-14829, PCT Laid Open Publication 83/02338A1, and European Patents 64,412A3 and 83,377A1) can also be used in the invention. Two or more types of silver halide which differ in crystal habit, halogen composition, grain size, a grain size distribution can also be used conjointly. Two or more types of mono-disperse emulsions which have different grain sizes can be mixed together to permit gradation control.

The grain size of the silver halide used in the invention is from 0.001 μm to 10 μm, and preferably from 0.001 μm to 5 μm. The silver halide emulsions can be prepared using any of the acidic method, neutral method or ammonia method, with either one-sided mixing, simultaneous mixing or a combination of these types of mixing for the reaction between the soluble silver salt and the soluble halide. The reverse mixing methods in which the grains are formed in the presence of excess silver ions or the controlled double jet method in which the pAg value is held constant can also be used. Furthermore, the concentrations, amounts being added or the rates of addition of the silver salt and the halide can be increased in order to speed up grain growth (for example, JP-A-55-142329, JP-A-55-158124 and U.S. Pat. No. 3,650,757).

Silver halide grains of the epitaxial junction type can also be used (JP-A-56-16124 and U.S. Pat. No. 4,094,684).

Ammonia, the organic thioether derivatives disclosed in JP-B-47-11386 and the sulfur containing compounds disclosed in JP-A-53-144319, for example, can be used as silver halide solvents in the formation stage of the silver halide grains which are used in the invention.

Cadmium salts, zinc salts, lead salts and thallium salts, for example, may be present during the formation or physical ripening of the grains.

Moreover, water soluble iridium salts, such as iridium (III, IV) chlorides and ammonium hexachloroiridate, or water soluble rhodium salts, such as rhodium chloride, can be used to improve reciprocity failure at high and low light levels.

The silver halide emulsion may be subjected to removal of the soluble salts after precipitation and formation of after physical ripening, and the noodle washing method and the precipitation method can be used for this purpose.

The silver halide emulsion can be used as it is after ripening, but chemical sensitization is normally used. The known methods of sulfur sensitization, reduction sensitization and precious metal sensitization conventionally used for normal photosensitive materials can be used individually or in combinations for this purpose. The chemical sensitization can also be carried out in the presence of nitrogen containing heterocyclic compounds (JP-A-58-126526 and JP-A-58-215644).

The silver halide emulsions used in the invention may be of the surface latent image type in which the latent image is formed principally on the grain surface, or of the internal latent image type in which the latent image is formed inside the grains. Direct reversal emulsions in which internal latent image type emulsions are combined with nucleating agents can also be used. Internal latent image type emulsions which are suitable for this purpose have been disclosed, for example, in U.S. Pat. Nos. 2,592,250 and 3,761,276, JP-B-58-3534 and JP-A-57-136641. A silver halide may be used in an amount of from 1 mg/m$^2$ to 20 g/m$^2$.

The silver halides used in the invention can be spectrally sensitized with methine dyes or by other means. The dyes which can be used for this purpose include cyanine dyes, merocyanine dyes, complex cyanine dyes, complex merocyanine dyes, holopolar cyanine dyes, hemi-cyanine dyes, styryl dyes and hemioxonol dyes. Dyes from among the cyanine dyes, merocyanine dyes and complex merocynaine dyes are especially useful in this connection. These dyes may have any of the nuclei normally used in cyanine dyes as the basic heterocyclic nucleus. That is to say, the basic heterocyclic nucleus may be, for example, a pyrroline nucleus, oxazoline nucleus, thiazoline nucleus, pyrrole nucleus, oxazole nucleus, thiazole nucleus, selenazole nucleus, imidazole nucleus, tetrazole nucleus or pyridine nucleus; a nucleus in which these nuclei are condensed with an alicyclic hydrocarbon ring; or a nucleus in which these nuclei are condensed with an aromatic hydrocarbon ring, for example, an indolenine nucleus, benzindoledine nucleus, indole nucleus, benzoxazole nucleus, naphthoxazole nucleus, benzothiazole nucleus, naphthothiazole nucleus, benzoselenazole nucleus, benzimidazole nucleus or a quinoline nucleus. These nuclei may also be substituted on the carbon atoms.

Five or six membered heterocyclic nuclei, such as the pyrazolin-5-one nucleus, the thiohydantoin nucleus, the 2-thiooxzazolidin-2,4-dione nucleus, the thiazolidin-2,4-dione nucleus, the rhodanine nucleus and the thiobarbituric acid nucleus, can be used as the nucleus which has a ketomethylene structure in the merocyanine dyes and complex merocynaine dyes.

These dyes may be used individually or in combinations, and combinations of sensitizing dyes are often used to achieve supersensitization.

Substances which, together with the sensitizing dyes, exhibit supersensitization, i.e., dyes which themselves have no spectrally sensitizing action or substances which have essentially no absorbance in the visible region, can be included in the emulsions.

Surfactants can be added either individually or in the form of mixtures to the photographic emulsions used in the invention.

These may be used as coating promotors, but they can also be used for other purposes, for examples for improving the emulsification and dispersion properties, for improving photographic characteristics, for anti-static purposes and for anti-adhesion purposes. These surfactants may be natural surfactants such as saponin, non-ionic surfactants such as the alkylene oxide based surfactants, glycerine based surfactants and the glycidol based surfactants, cationic surfactants such as the higher alkylamines, quaternary ammonium salts, heterocyclic compounds such as pyridine and phosphonium and sulfonium compounds, anionic surfactants which contain an acidic group, such as a carboxylic acid group, sulfonic acid group, phosphoric acid group, sulfate ester group or a phosphate ester group, or an amphoteric surfactant, such as the amino acids, aminosulfonic acids, and the sulfate and phosphate esters of aminoalcohols. Furthermore, the use of fluorine containing surfactants is preferred for the surfactants used as anti-static agents.

Various compounds can be included in the photographic emulsions used in the invention to prevent the occurrence of fogging during the manufacture, storage or photographic processing of the photosensitive material or with a view to stabilizing photographic performance. Thus, many compounds which are known as antifogging agents or stabilizers, such as the azoles, for example, benzothiazolium salts, nitroimidazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles and mercaptotetrazoles (especially 1-phenyl-5-mercaptotetrazole); mercaptopyrimidines; mercaptotriazines; thioketo compounds such as, for example, oxazolinethione; azaindenes, for example, triazaindenes, tetra-azaindenes (especially 4-hydroxy substituted (1,3,3a,7)tetraazaindenes) and pentaazaindenes; benzenethiosulfonic acid, benzenesulfinic acid, and benzenesulfonic acid amide can be added for this purpose.

Thioether compounds, thiomorpholines, quaternary ammonium salt compounds, urethane derivatives, urea derivatives, imidazole derivatives and 3-pyrazolidones, for example, may be included in the photographic emulsion layers of the photographic materials of this invention with a view to increasing photographic speed, raising contrast or accelerating development.

Dispersions of water insoluble or sparingly soluble synthetic polymers can be included in the photographic materials used in the invention with a view to improving the dimentional stability of the photographic emulsion layers and other hydrophilic colloid layers. For example, use can be made of polymers in which alkyl (meth)acrylates, alkoxyalkyl (meth)acrylates, acrylonitrile, olefins and styrene, for example, are used individually or in combinations as monomer units, and polymers in which these monomer units are combined with acrylic acid, methacrylic acid, and $\alpha,\beta$-unsaturated carboxylic acids, for example, as monomer components.

Hydrophilic colloids are preferred as the binders which are used in the emulsion layers and auxiliary layers (for example protective layers and intermediate layers) of photosensitive materials of this invention, and the use of gelatin is especially desirable. For example, use can be made of gelatin derivatives, graft polymers of gelatin and other polymers, proteins such as albumin and casein; cellulose derivatives. Such as hydroxyethylcellulose, carboxymethylcellulose and cellulose sulfate esters, sodium alginate and sugar derivatives such as starch derivatives; and various types of synthetic hydrophilic homopolymers or copolymers, such as poly(vinyl alcohol), partially acetalated poly(vinyl alcohol), poly(N-vinylpyrrolidone), poly(acrylic acid), poly(methacrylic acid), polyacrylamide, polyvinylimidazole and polyvinylpyrazole. Use can also be made of lime treated gelatin, acid treated gelatin and enzyme treated gelatin.

Inorganic or organic film hardening agents can be included in the photographic emulsion layers and other hydrophilic colloid layers of the photographic materials of this invention. For example, chromium salts (for example chrome alum and chromium acetate), aldehydes (for example formaldehyde, glyoxal and glutaraldehyde), N-methylol compounds (for example dimethylol urea and methyloldimethylhydantoin), dioxane derivatives (for example 2,3-dihydroxydioxane), active vinyl compounds (for example 1,3,5-triacryloylhexahydro-s-triazine and 1,3-vinylsulfonyl-2-propanol), active halogen compounds (for example 2,4-dichloro-6-hydroxy-s-triazine), mucohalogen acids (for example mucochloric acid and mucophenoxychloric acid) can be used either individually or in combination for this purpose.

Various other additives can be used in silver halide photographic materials of this invention. For example, bleaching agents, dyes, desensitizing agents, coating promotors, anti-static agents, plasticizers, lubricating agents, matting agents, development accelerators, mordants, ultraviolet absorbers, anti-color fading agents, and anti-color fogging agents may be used.

The additives disclosed, for example, on pages 22 to 31 of *Research Disclosure* No. 176 (RD-17643) (December, 1978), can be used.

The invention can be applied to various types of silver halide photographic material. Specific examples are described below, but the present invention is not to be construed as being limited thereto.

(1) For example, compounds of this invention are effective for improving the picture quality of silver halide photographic materials for photographic plate making purposes which have a layer of silver chlorobromide or silver chloroiodobromide emulsion which contains at least 60% of silver chloride and 0 to 5% of silver iodide (the emulsion is preferably a mono-disperse emulsion) and which contain polyalkyleneoxides. For example, it is possible to improve the cutting of the toe part without adversely affecting halftone dot quality when PUG in compound [I] is a development inhibitor. In these cases, the compound of this invention is preferably used in an amount within the range from $1\times10^{-7}$ to $1\times10^{-1}$ mol, and preferably in an amount within the range from $1\times10^{-6}$ to $1\times10^{-2}$ mol, per mol of silver halide.

Furthermore, the polyalkyleneoxide compounds used here may be added either to the silver halide photographic material or to the development bath, or to both the silver halide photographic material and the development bath.

The polyalkyleneoxide compounds include condensates or block copolymers of polyalkyleneoxides consisting of at least ten units of an alkyleneoxide which has from 2 to 4 carbon atoms, for example ethyleneoxide, propylene-1,2-oxide, butylene-1,2-oxide, and preferably ethyleneoxide, and a compound which has at least one active hydrogen atom, such as water, aliphatic alcohols, aromatic alcohols, fatty acids, organic amines, and hexitol derivatives. Polyalkyleneglycols, polyalkyleneglycol alkyl ethers, polyalkyleneglycolaryl ethers, polyalkyleneglycol(alkylaryl) ethers, polyalkyleneglycol esters, polyalkyleneglycol fatty acid amides, polyalkyleneglycolamines, polyalkyleneglycol block copolymers, and polyalkyleneglycol graft polymers can be used.

The use of those of molecular weight ranging from 500 to 10,000 is preferred.

Just one type of polyalkylene oxide compound may be used, or two or more of these compounds can be used conjointly.

In those cases where the above mentioned polyalkyleneoxide compounds are added to the silver halide photographic material, they can be added in an amount in the range from $5\times10^{-4}$ to 5 grams, and preferably from $1\times10^{-3}$ to 1 gram, per mol of silver halide. When added to the development bath, the above mentioned polyalkyleneoxide compounds are added in an amount in the range from 0.1 to 10 grams per liter of development bath.

(2) The invention is also effective for improving the black pepper effect seen in photographic materials which have a mono-disperse silver halide emulsion layer which can form very high contrast negative images in a stable developer as a result of the action of a hydrazine derivative, as disclosed, for example, in U.S. Pat. Nos. 4,224,401, 4,168,977, 4,241,164, 4,311,781, 4,272,606, 4,221,857, 4,243,739, 4,272,614 and 4,269,929. "Black pepper" signifies the formation of spot like black dots in the non-image parts (for example in the regions between halftone dots) and it is particularly prevalent when the development bath is fatigued due to aging and when the sulfite ion used as a preservative is depleted, and when the pH of the bath has risen, and it results in a loss of image quality. A "stable development bath" signifies a development bath which contains at least 0.15 mol/liter of sulfite ion as a preservative and of which the pH is in the range from 10.0 to 12.3. Such a developer is more stable than a normal lith developer (which usually contains only a very small amount of sulfite ions). Since it contains a large quantity of preservative and, since it has a comparatively low pH, it is less prone to aerial oxidation and more stable than the high contrast image forming development baths (pH=12.8) disclosed, for example, in U.S. Pat. No. 2,419,975. In this case, the compound of general formula (I) of the invention preferably has a development inhibitor for the PUG, and it is used at a rate within the range from $1\times10^{-6}$ to $10^{-1}$ mol, and preferably at a rate within the range from $1\times10^{-5}$ to $1\times10^{-1}$ mol, per mol of silver halide.

When, in this invention a hydrazine derivative is included in the photographic material, it is preferably included in a silver halide emulsion layer, but it may be included instead in a non-photosensitive hydrophilic colloid layer (for example, in a protective layer, intermediate layer, filter layer or anti-halation layer). In practice, the compounds which are used may be added to the hydrophilic colloid solution in the form of an aqueous solution when they are water soluble or as a solution in an organic solvent which is miscible with water, such as an alcohol, ester or ketone, in cases where they are sparingly soluble in water. When they are added to a silver halide emulsion layer the addition can be made at any time during the interval from the commencement of chemical sensitization and before coating, but addition during the interval after the completion of chemical sensitization and before coating is preferred. Addition to the coating liquid which is to be used for coating is especially desirable.

The amount of these hydrazine compounds added is preferably selected optimally in accordance with the grain size, halogen composition of the silver halide emulsion, the method of chemical sensitization used, the relationship between the layer in which the compound is to be included and the silver halide emulsion layer, and the type of anti-foggant which is being used, and the test methods which are used in making such a selection are well known to those in the industry. Normally, they are used in amounts in the range from $10^{-6}$ to $1\times10^{-1}$ mol, and most preferably from $10^{-5}$ to $4\times10^{-2}$ mol, per mol of silver halide.

The invention can be applied to multi-layer multicolor photographic materials which have at least two layers with different spectral sensitivities on a support, to prevent the occurrence of fogging and control contrast, improve color reproduction, and increase photographic speed. Multi-layer natural color photographic materials normally have at least one red sensitive emulsion layer, at least one green sensitive emulsion layer and at least one blue sensitive emulsion layer on a support. The order in which these layers are arranged is optional, according to the requirements. The preferred arrangements for the layers are, from the support red sensitive layer, green sensitive layer, blue sensitive layer or, form the support, blue sensitive layer, green sensitive layer, and red sensitive layer. Furthermore, each of the aforementioned emulsion layers may consist of two or more emulsion layers which have different sensitivities, and non-photosensitive layers may be present between two or more emulsion layers which have the same sensitivity. Normally, a cyan forming coupler is included in the red sensitive emulsion layer, a magenta forming coupler is included in the green sensitive layer and a yellow forming coupler is included in the blue sensitive layer, but different combinations can be used depending on the particular case.

No limitation is imposed on the couplers which can be used, and 5-pyrazolone couplers, pyrazolotriazole couplers, pyrazolobenzimidazole couplers, cyanoacetylchroman couplers and open chain acylacetonitrile couplers are used, for example, as magenta couplers; acylacetamide couplers (for example benzoylacetanilide and pivaloylacetanilides) are used as yellow couplers; and naphthol couplers and phenol couplers are used as cyan couplers. Furthermore, ureido cyano couplers and diacylaminophenol couplers can be used as cyan couplers. These couplers are rendered fast to diffusion with ballast groups, which are hydrophobic groups, in the molecule or, more desirably, they are formed into polymers. The couplers may be either four-equivalent or two-equivalent with respect to silver ions. Furthermore, colored couplers which have a color correcting effect, or couplers which release development inhibitors or development accelerators as development proceeds (DIR couplers and DAR couplers) can also be used.

Furthermore, non-color forming DIR coupling compounds of which the products of the coupling reaction are colorless but which release development inhibitors can also be included as well as the DIR couplers.

Compounds other than DIR couplers which release development inhibitors along with development can also be included in the photosensitive materials.

Two or more of the above mentioned couplers can be used conjointly in the same layer, or the same compound can be added to two or more different layers, in order to satisfy the characteristics required of the photosensitive material.

The compounds of this invention can be used conjointly with couplers, and they can be added to the same emulsion layers as the couplers or they can be added to an auxiliary photographic layer such as an intermediate layer in the form of an emulsified dispersion.

The compounds of this invention are used in an amount of from 0.1 to 50 mol % and preferably from 0.3 to 15 mol % with respect to the yellow coupler in the blue sensitive layer, the magenta coupler in the green sensitive layer or the cyan coupler in the red sensitive layer, which is to say with respect to the coupler in each photosensitive layer, in color photosensitive materials. Furthermore, they are preferably used in an amount of from $1\times10^{-5}$ to $8\times10^{-2}$ mol, and preferably from $1\times10^{-4}$ to $5\times10^{-2}$ mol, per mol of silver halide in the layer to which they are added.

In cases where dyes and ultraviolet absorbers are included in the hydrophilic colloid layers in photosensitive materials prepared using this invention they may be mordanted by means of a cationic polymer.

The photosensitive materials according to this invention may contain hydroquinone derivatives, aminophenol derivatives, gallic acid derivatives, or ascorbic acid derivatives as anti-color fogging agents.

Ultraviolet absorbers may be included in the hydrophilic colloid layers of photosensitive materials prepared using this invention. For example, compounds such as the aryl substituted benzotriazole compounds (for example, those disclosed in U.S. Pat. No. 3,533,794), the 4-thiazolidone compounds (for example, those disclosed in U.S. Pat. Nos. 3,214,794 and 3,352,681) and the benzophenone compounds (for example, those disclosed in JP-A-46-2784) can be used for this purpose. These ultraviolet absorbers can be mordanted in a specific layer.

Water soluble dyes can be included in the hydrophilic colloid layers of photosensitive materials made using this invention as filter dyes or for antihalation or other purposes. Dyes of this type include oxonol dyes, hemioxonol dyes, styryl dyes, merocyanine dyes, cyanine dyes and azo dyes. Among these dyes, the oxonol dyes, hemioxonol dyes and merocyanine dyes are most useful.

Conventional anti-color fading agents can be used in the invention, and the colored image stabilizers used in the invention can be used independently or two or more types can be used conjointly. Known anti-color fading agents include hydroquinones, gallic acid derivatives, p-alkoxyphenols, p-oxyphenol derivatives and bisphenols.

Any of the known methods can be used for the photographic processing of photosensitive materials of this invention and the known processing baths can be used for this purpose. A processing temperature of between 18° C. and 50° C. is normally selected, but temperatures below 18° C. and above 50° C. can be used. Either a developing process in which a silver image is formed (black-and-white photographic processing) or color photographic processing consisting of a development process in which a dye image is formed can be used. Furthermore, thermal development, can be used.

The known developing agents, such as the dihydroxybenzenes (for example, hydroquinone), the 3-pyrazolidones (for example 1-phenyl-3-pyrazolidone), and the amino phenols (for example N-methyl-p-aminophenol) can be used either individually or in combinations in black and white development baths.

Color development baths generally consist of an aqueous alkaline solution which contains a color developing agent. The known primary aromatic amine developing agents, for example the phenylenediamines (for example 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfonamidoethylaniline and 4-amino-3-methyl-N-ethyl-N-β-methoxyethylaniline) can be used for the color developing agent.

Those disclosed, for example, on pages 226 to 229 of *Photographic Processing Chemistry*, by L. F. A. Mason (Focal Press, 1966) and in U.S. Pat. Nos. 2,193,015 and 2,592,364, and in JP-A-48-64933, can also be used.

The known process such as fixing, bleaching, stabilizing, bleach-fixing, stopping, washing and stabilization are carried out after development. Methods in which the amount of water used is greatly restricted can be used for water washing and stabilization.

The invention is described in greater detail below with reference to specific illustrative examples, but the invention is not to be construed as being limited thereto. Unless otherwise indicated, all parts percents and rations are by weight.

EXAMPLE 1

Samples A to H were prepared by coating emulsion layers to which emulsified dispersions of solutions obtained by dissolving the anti-foggants and blocked photographic reagents (precursors) of this invention, shown in table 1, along with a coupler (Cp-1), in tricresyl phosphate had been coated on cellulose triacetate film supports on which an under-layer had been coated in order to evaluate the compounds of this invention and control (comparative) compounds, with respect to the efficiency of the anti-foggant precursors of this invention. The amount of each substance coated is indicated in brackets in units of g/m² or mol/m².

| | |
|---|---|
| (1) Emulsion Layer | |
| Negative type silver iodobromide emulsion, average grain size 1.4 μm | as silver, $1.6\times10^{-2}$ mol/m² |
| Magenta coupler Cp-1 | $1.33\times10^{-3}$ mol/m² |
| Anti-foggant or Precursor compound of this invention | See Table 1 |
| Gelatin | 2.50 g/m² |
| (2) Protective Layer | |
| Gelatin | 1.30 g/m² |
| 2,4-Dichloro-6-hydroxy-s-triazine, sodium salt | 0.05 g/m² |

The films obtained were stored for 14 hours under conditions of 40° C., 70% relative humidity, after which they were exposed imagewise for sensitometric purposes and then they were subjected to the color development processing indicated below.

| Color Development Processing | Time | Temperature |
|---|---|---|
| 1. Color development | 3 min. 15 sec. | 38° C. |
| 2. Bleach | 6 min. 30 sec. | 38° C. |
| 3. Water Wash | 2 min. | 38° C. |
| 4. Fix | 4 min. | 38° C. |
| 5. Water Wash | 4 min. | 38° C. |
| 6. Stabilization | 1 min. | 38° C. |

The composition of each of the processing baths used in the color development processing is indicated below.

| | |
|---|---|
| Color Development Bath | |
| Water | 800 ml |
| 4-(N-Ethyl-N-hydroxyethyl)amino-2-methylaniline sulfate | 5 g |
| Sodium sulfate | 5 g |
| Hydroxylamine sulfate | 2 g |
| Potassium carbonate | 30 g |
| Potassium bicarbonate | 1.2 g |
| Potassium bromide | 1.2 g |
| Sodium chloride | 0.2 g |
| Trisodium nitriloacetate | 1.2 g |
| Water to make up to | 1 l |
| pH | 10.1 |
| Bleach Bath | |
| Water | 800 ml |
| Ethylenediamine tetra-acetic acid. ferric ammonium salt | 100 g |
| Ethylenediamine tetra-acetic acid. di-sodium salt | 10 g |
| Potassium bromide | 150 g |
| Acetic acid | 10 g |
| Water to make up to | 1 l |
| pH | 6.0 |
| Fixer Bath | |
| Water | 800 ml |
| Ammonium thiosulfate | 150 g |
| Sodium sulfite | 10 g |
| Sodium bisulfite | 2.5 g |
| Water to make up to | 1 l |
| pH | 6.0 |
| Stabilizer Bath | |
| Water | 800 ml |
| Formalin (37%) | 5 ml |
| "Driwell" | 3 ml |
| Water to make up to | 1 l |

The photographic properties obtained were as shown in Table 1.

The coupler and comparative anti-foggant used are shown below.

CP-1

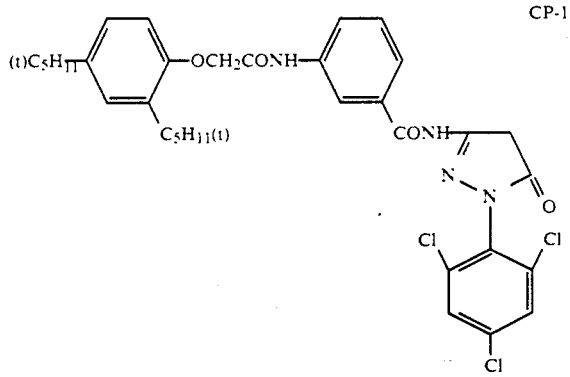

A-1

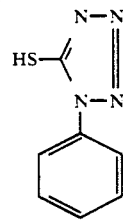

A-2

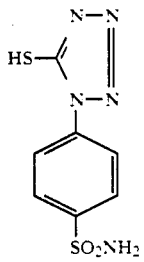

A-3

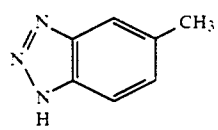

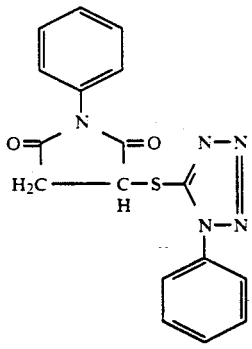

(Precursors disclosed in U.S. Pat. No. 3,888,677)

TABLE 1

| Sample | Amounts of the Precursor Cpds. of the Invention and Comparative anti-foggants added (mol/m²) | | Fog | Gamma | Relative Sensitivity* | Maximum Color Density |
|---|---|---|---|---|---|---|
| A (Standard) | — | — | 0.12 | 0.82 | 100 | 1.61 |
| B (Invention) | (1)** | $1.1 \times 10^{-5}$ | 0.06 | 0.75 | 94 | 1.50 |
| C (Invention) | (18)** | $1.1 \times 10^{-5}$ | 0.07 | 0.80 | 96 | 1.56 |
| D (Invention) | (49)*** | $2.2 \times 10^{-5}$ | 0.08 | 0.82 | 98 | 1.60 |
| E (Invention) | (46)**** | $1.1 \times 10^{-4}$ | 0.09 | 0.84 | 100 | 1.60 |

TABLE 1-continued

| Sample | Amounts of the Precursor Cpds. of the Invention and Comparative anti-foggants added (mol/m²) | | Fog | Gamma | Relative Sensitivity* | Maximum Color Density |
|---|---|---|---|---|---|---|
| F (Comparative Example) | A-1 | $2.2 \times 10^{-6}$ | 0.05 | 0.40 | 25 | 0.92 |
| G (Comparative Example) | A-2 | $4.4 \times 10^{-6}$ | 0.03 | 0.53 | 30 | 1.07 |
| H (Comparative Example) | A-3 | $2.2 \times 10^{-5}$ | 0.08 | 0.64 | 52 | 1.35 |
| I (Comparative Example) | A-4 | $1.1 \times 10^{-5}$ | 0.07 | 0.71 | 74 | 1.25 |

*Relative Sensitivity: The reciprocal of the exposure required to provide a color of fog + 0.2, the value being expressed as a value relative to that for the control sample which was taken to be 100.
**Compound (1) and (18) are the anti-foggant A-1 blocked in accordance with this invention.
***Compound (49) is the anti-foggant A-2 blocked in accordance with this invention.
****Compound (46) is the anti-foggant A-3 blocked in accordance with this invention.

It is clear from table 1 that with samples B to E in which compounds of this invention were used there was hardly any reduction of gamma, speed or maximum color density and that fogging was suppressed.

EXAMPLE 2

Sample B (this invention) and sample I (sample containing a comparative precursor) of example 1 were stored for 1 week under conditions of 40° C., 80% RH. after which they were exposed and processed in the same way as in example 1. Sample I displayed a much more pronounced fall in gamma, speed and maximum color density than example B.

From these facts it can be concluded that while the precursor in sample I released the blocking group during storage and the stability is poor, the precursor of this invention had a high storage stability.

EXAMPLE 3

Four liters of an aqueous solution containing 1 kg of silver nitrate and 4 liters of an aqueous solution containing 210 grams of potassium bromide and 290 grams of sodium chloride were added simultaneously at a constant rate over a period of 30 minutes to 6 liters of an aqueous solution which contained 70 grams of gelatin.

Gelatin was added after removing the soluble salts, gold and sulfur sensitization was carried out and a silver chlorobromide emulsion (grain size 0.27 μm, 30 mol % Br) was obtained. 4-Hydroxy-6-methyl-1,3,3a,7-tetraazaindene was added to this emulsion as a stabilizer.

Blocked photographic reagents (precursors) were added, as shown in table 2, to this emulsion. 1-Hydroxy-3,5-dichlorotriazine, sodium salt, and sodium dodecylbenzenesulfonate were then added as film hardening agent and coating promotor respectively and the emulsions were coated so as to provide a coated silver weight of 4.2 g/m² on polyethyleneterephthalate films.

The film samples obtained in this way were exposed through an optical wedge using a $10^{-5}$ second xenon flash light and they were then developed for 4 minutes at 27° C. in the development bath indicated below, stopped and fixed, and then they were washed with water and dried. Density measurements were then made using a P-type densitometer made by the Fuji Photographic Film Co. and the speed and fog values were obtained. The standard optical density for determining speed was set at fog +0.5. The results obtained are shown in Table 2.

| Development Bath Formula | |
|---|---|
| Metol | 0.31 g |
| Anhydrous sodium sulfite | 39.6 g |
| Hydroquinone | 6.0 g |
| Anhydrous sodium carbonate | 18.7 g |
| Potassium bromide | 0.86 g |
| Citric acid | 0.68 g |
| Potassium metabisulfite | 1.5 g |
| Water to make up to | 1 l |

TABLE 2

| Sample No. | Precursor of the Invention | Amount of the Precursor of the Invention Added (mol/kg emulsion) | Fog | Density |
|---|---|---|---|---|
| 1 (Control) | — | — | 0.07 | 100 (Std) |
| 2 (Invention) | (1) | $3 \times 10^{-4}$ | 0.04 | 93 |
| 3 (Invention) | (12) | " | 0.04 | 93 |
| 4 (Invention) | (18) | " | 0.04 | 94 |
| 5 (Invention) | (21) | " | 0.05 | 95 |
| 6 (Invention) | (55) | " | 0.04 | 92 |
| 7 (Invention) | (57) | " | 0.05 | 98 |
| 8 (Invention) | (58) | " | 0.05 | 97 |
| 9 (Comparative Example) | A-1 | " | 0.05 | 47 |

Comparative Compound A-1

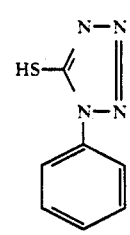

It is clear from the results shown in table 2 that the compounds of this invention suppressed fogging with very little loss of speed when compared to comparative compound A-1.

EXAMPLE 4

Emulsions [I] and [II] were prepared using the methods indicated below.

Emulsion I

An aqueous silver nitrate solution and an aqueous solution of potassium iodide and potassium bromide were added simultaneously over a period of 60 minutes in the presence of ammonia and potassium hexachloroiridate ($4\times10^{-7}$ mol per mol of silver) to an aqueous gelatin solution which was maintained at 50° C. and, by maintaining the pAg value at 7.8 throughout this period, a cubic, mono-disperse emulsion of average grain size 0.28 μm and of average silver iodide content 1 mol % was obtained. Moreover, this emulsion was washed in a conventional manner to remove the soluble salts, after which gelatin was added. Then 0.1 mol % per mol of silver of an aqueous potassium iodide solution was added to achieve conversion of the grain surfaces and emulsion I was obtained.

Emulsion II

Emulsion II of average grain size 0.25 μm was prepared in just the same way by adjusting the amount of ammonia used for emulsion I.

5,5'-Dichloro-9-ethyl-3,3'-bis(3-sulfopropyl)oxacarbocyanine, sodium salt, was added to these silver iodobromide emulsions as a sensitizing dye, 4-hydroxy-6-methyl-1,3,3a,7-tetra-azaindene was added as a stabilizer, and a dispersion of poly(ethyl acrylate), aqueous latex (a) of which the structural formula is indicated below, polyethylene glycol, 1,3-divinylsulfonyl-2-propanol and the compound B indicated below were added, and precursor compounds of general formula (I) of the invention were also added as shown in table 3, after which the emulsions were coated so as to provide a coated silver weight of 3.4 g/m² on polyethyleneterephthalate films to provide samples 1 to 7.

Aqueous Latex (a)

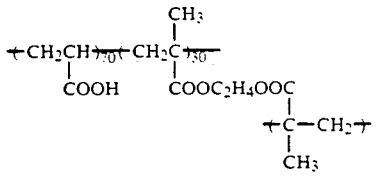

Compound B

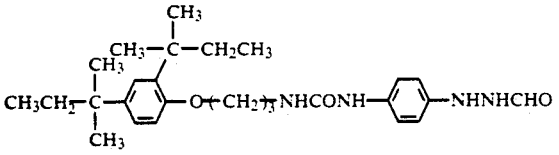

Samples 8 to 14, which contained comparative compounds (a), (b), (c) and (d), were prepared in the same way. Each sample was exposed and developed and their photographic characteristics as photosensitive materials for plate making purposes were evaluated.

* Relative Sensitivity: This was the relative value of the reciprocal of the exposure required to provide a density of 1.5 with 30 seconds development at 38° C., taking the value for sample 1 to be 100.

* Black Pepper: This was evaluated in five levels by microscopic observation, the best quality being given a score of 5 and the worst quality a scope of 1. Scores of 5 and 4 are satisfactory for practical use, a score of 3 is poor but could be used in practice, and a score of 2 or 1 is such that the material is of no practical use. Results lying between levels 3 and 4 were given a scope of 3.5, and results lying between levels of 4 and 5 were given a score of 4.5.

* Evaluation of Black Pepper: These are the results obtained with a 40 seconds development at 38° C.

Comparative Compound (a)

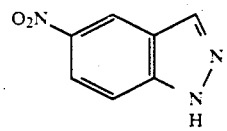

Comparative Compound (b)

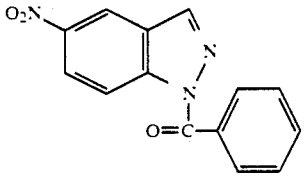

Comparative Compound (c)

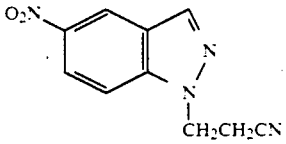

The results are shown in table 3 under photographic characteristics 1. The development was carried out using a development bath of which the formula is indicated below.

| Development Bath | |
|---|---|
| Hydroquinone | 45.0 g |
| N-Methyl-p-aminophenol, hemi-sulfate | 0.8 g |
| Sodium hydroxide | 18.0 g |
| Potassium hydroxide | 55.0 g |
| 5-Sulfosalicylic acid | 45.0 g |
| Boric acid | 25.0 g |
| Potassium sulfite | 110.0 g |
| Ethylenediamine tetra-acetic acid, di-sodium salt | 1.0 g |
| Potassium bromide | 6.0 g |
| 5-Methylbenzotriazole | 0.6 g |
| n-Butyldiethanolamine | 15.0 g |
| Water to make up to | 1 l |
| pH | 11.6 |

Furthermore, each unprocessed sample was left to stand for 3 days under conditions of 50° C., 75% RH, after which the photographic characteristics were evaluated in the same way as before. The results obtained are shown in Table 3 under photographic characteristics 2.

TABLE 3

| Sample No. | Emulsion Used | Amount of Cpd. B Added (mol/mol · Ag) | Type of Precursor | Amount of Precursor Added (mol/mol · Ag) | Photographic Characteristics 1 | | Black Pepper | Photographic Characteristics 2 | |
|---|---|---|---|---|---|---|---|---|---|
| | | | | | Sensitivity | Gamma | | Sensitivity | Gamma |
| 1 | I | $2 \times 10^{-4}$ | — | — | 100 | 15.0 | 2 | 98 | 14.0 |
| 2 | I | $3 \times 10^{-4}$ | — | — | 100 | 16.6 | 1 | 102 | 16.0 |
| 3 | II | $3 \times 10^{-4}$ | — | — | 79 | 14.5 | 3.5 | 77 | 14.0 |
| 4 | II | $4 \times 10^{-4}$ | — | — | 85 | 16.0 | 2.5 | 83 | 16.0 |
| 5 | I | $3 \times 10^{-4}$ | (4) | $5.4 \times 10^{-4}$ | 99 | 16.1 | 4 | 98 | 15.5 |
| 6 | I | $3 \times 10^{-4}$ | (4) | $1.1 \times 10^{-3}$ | 93 | 14.2 | 4.5 | 91 | 13.9 |
| 7 | I | $4 \times 10^{-4}$ | (4) | $1.1 \times 10^{-3}$ | 104 | 16.6 | 4 | 100 | 16.0 |
| 8 | I | $3 \times 10^{-4}$ | Comp. Cpd. (a) | $5.4 \times 10^{-4}$ | 89 | 12.4 | 4.5 | 89 | 11.0 |
| 9 | I | $3 \times 10^{-4}$ | " | $1.1 \times 10^{-3}$ | 79 | 10.6 | 4.5 | 77 | 9.0 |
| 10 | I | $3 \times 10^{-4}$ | Comp. Cpd. (b) | $5.4 \times 10^{-4}$ | 92 | 12.3 | 4.5 | 79 | 9.0 |
| 11 | I | $3 \times 10^{-4}$ | " | $1.1 \times 10^{-3}$ | 80 | 10.6 | 5 | 70 | 8.0 |
| 12 | I | $3 \times 10^{-4}$ | Comp. Cpd. (c) | $5.4 \times 10^{-4}$ | 100 | 14.8 | 2 | 98 | 14.1 |
| 13 | I | $3 \times 10^{-4}$ | " | $1.1 \times 10^{-3}$ | 100 | 15.0 | 1.5 | 98 | 14.0 |
| 14 | I | $4 \times 10^{-4}$ | " | $1.1 \times 10^{-3}$ | 101 | 16.3 | 1 | 102 | 15.0 |

It is clear from table 3 that samples 1 and 2 in which compounds of general formula (I) were not used exhibited good speed and gradation but that their black pepper characteristics were poor. The was no marked improvement on changing the speed by changing from emulsion [I] to emulsion [II].

Comparative samples (8) and (9) in which comparative compound (a) were used conjointly were good with respect to black pepper but they had a low speed and low contrast. Samples (12) to (14) had good gradation but the release rate was low and they were poor with respect to black pepper. On the other hand, samples (10) and (11) had remarkably low speed and gamma values, especially in the forced degradation test (photographic characteristics 2), since the comparative compound (b) being unstable.

On the other hand, for samples (5) to (7) in which compounds represented by the general formula (I) of this invention were processed, the results obtained were good with respect to black pepper and they exhibited good speed and gradation, even in the forced degradation test.

EXAMPLE 5

(1) Preparation of a Photosensitive Silver Halide Emulsion

An aqueous solution containing potassium bromide and sodium chloride was added using the double jet method with an aqueous solution of silver nitrate to an acidic (pH 4) aqueous gelatin solution which was being stirred vigorously to prepare a cubic, mono-disperse emulsion of average grain size 0.4 μm (50 mol % silver bromide, dispersion coefficient 14%). This was subsequently washed using a normal precipitation method, after which it was subjected to sulfur sensitization to provide a photosensitive silver chlorobromide emulsion.

(2) Preparation of Coated Samples

Samples 1 to 7 were formed by establishing sequentially from the support side on a paper support (thickness 200 μm), which had been laminated on both sides with polyethylene, each of the layers of which the formulations are indicated below.

Moreover, for comparison, samples were also prepared using the comparative compounds C-1, C-2 and C-3 indicated hereinafter in place of the precursors of this invention.

| | |
|---|---|
| Emulsion Layer | |
| Binder: Gelatin | 4.7 g/m² |
| Coated silver weight | 1.5 g/m² |
| Sensitizing Dye: | 0.3 mg/m² |

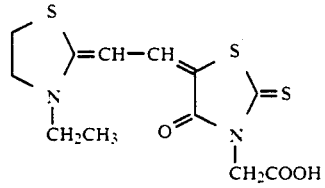

| | |
|---|---|
| Coating Promotor: Sodium dodecylbenzenesulfonate | 7 mg/m² |
| Fluorescent Whitener: W-1 | 0.1 g/m² |
| Polymer Latex: Poly(ethyl acrylate) | 2 g/m² |
| Toner (Precursor of this invention): See table 4 | |
| Surface Protective Layer | |
| Binder: Gelatin | 2.0 g/m² |
| Coating Promotor: Sodium dodecylbenzenesulfonate | 80 mg/m² |
| Colloidal silica (Average 0.05 μm) | 0.3 g/m² |
| Film Hardening Agent: 4-Dichloro-6-hydroxy-1,3,5-triazine, sodium salt | 0.08 g/m² |

(3) Sensitometry

The coated samples were stored for 7 days under conditions of 25° C., 65% RH. The samples were then evaluated using the methods described below. The results for the photographic characteristics are shown in table 4.

(A) Sensitivity Evaluation

Each sample was exposed for 1 second through a continuous wedge using tungsten light of color temperature 2854K, 400 lux, after which they were developed for 90 seconds at 20° C. using a development bath obtained by diluting Fuji "Papitol" developer (made by the Fuji Photo Film Co., Ltd.) with water in the proportions 1:1, and stopped, after which it was fixed for 5 minutes in "Fujifix" (made by the Fuji Photo Film Co., Ltd.), washed with water and dried. The photographic speed was evaluated for each sample as the exposure required using this same method to provide a fixed optical density of 10.6 above the fog density.

(B) Evaluation of Fogging

Each sample was developed for 5 minutes at 30° C. in Fuji "Papitol" developer (made by the Fuji Photo Film Co., Ltd.), stopped, fixed, washed with water and dried, after which the fog density was evaluated.

(C) Evaluation of Tone

Each sample was exposed, developed, stopped, fixed, washed and dried in the same way as in (A) above, after which the tone was evaluated.

(D) Safe-light Stability

Samples 1 to 7 were left to stand for 20 minutes at a perpendicular distance of 1 meter from a safe-light, a Fuji Safe-light No. 6 (made by the Fuji Photo Film Co., Ltd.) fitted with a 100 V. 20 W tungsten lamp, after which they were developed, stopped, fixed, washed and dried in the same way as in (A) above, and fog density was evaluated.

It is clear from table 4 that with the conventional compounds such as those added to samples 2 to 4, when enough was added to provide a warm tone there was a marked loss of sensitivity and a worsening in respect of blackening on exposure to a safe-light. On the other hand, with the compounds of this invention added to samples 5 to 7 it was possible to obtain a warm tone with no loss of speed and no worsening of the blackening due to safe-light exposure.

EXAMPLE 6

Emulsion Preparation

An aqueous solution of silver nitrate and an aqueous solution of sodium chloride which contained $1.0\times10^{-4}$ mol per mol of silver of ammonium hexachlororhodinate were mixed with a gelatin solution at 35° C. using the double jet method such that the pH value was maintained at 2.3, and a monodisperse silver chloride emulsion of average particle size 0.1 μm was obtained.

After forming the grains, the soluble salts were removed using the flocculation method well known in the industry and 1-phenyl-5-mercaptotetrazole and 4-hydroxy-6-methyl-1,3,3a,7-tetra-azaindene were added as stabilizers. This emulsion contained 55 grams of gelatin and 105 grams of silver per kilogram.

TABLE 4

| Type of Precursor of the Invention | Amount of Precursor of the Invention Added ($mg/m^2$) | Sensitivity | Fog | Tone | Blackened Density Under Safe-light |
|---|---|---|---|---|---|
| None Added | — | 100 | 0.36 | Cold | 0.00 |
| Comparative Compound C-1 | 4.5 | 56 | 0.00 | Warm | 0.04 |
| Comparative Compound C-2 | 4.5 | 38 | 0.00 | Warm | 0.05 |
| Comparative Compound C-3 | 4.5 | 43 | 0.00 | Warn | 0.03 |
| (1) | 9.0 | 106 | 0.00 | Warm | 0.00 |
| (13) | 9.0 | 101 | 0.00 | Warm | 0.00 |
| (2) | 9.0 | 108 | 0.01 | Warm | 0.00 |

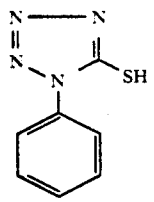

Comparative Compound C-1

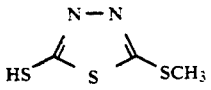

Comparative Compound C-2

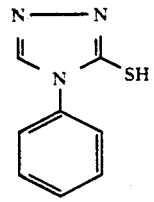

Comparative Compound C-3

Preparation of Photosensitive Materials

The nucleating agent D-1 of which the formula is shown below (9 mg/gram of silver), the organic desensitizing agent of which the formula is shown below (2 mg/gram of silver) were added to the above mentioned emulsion, and 2,4-dichloro-6-hydroxy-1,3,5-triazine, sodium salt, was added as a film hardening agent and a silver halide emulsion layer was coated on a transparent polyethyleneterephthalate support to provide a coated silver weight of 3.5 $g/m^2$. A protective layer containing gelatin (1.3 $g/m^2$) and compound (32) of this invention (0.13 $g/m^2$) was then coated over this layer and dried (Sample 1).

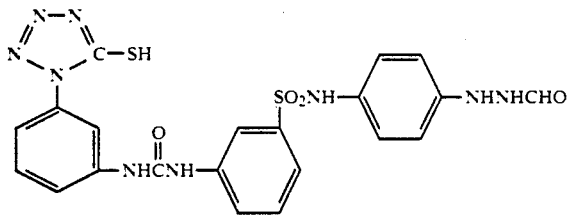

Nucleating Agent D-1

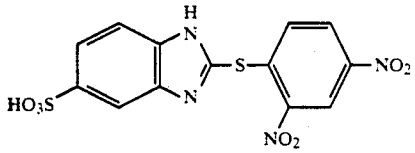

Organic Desensitizing Agent

Moreover, a gelatin dispersion of the compound (32) was prepared and provided for coating in the following way. Thus a solution obtained by dissolving 6.4 grams of the compound (32) in 39 ml of methyl ethyl ketone and equimolar sodium hydroxide (1N) was mixed with at 45° C. with 260 grams of 5% (by weight) aqueous gelatin solution with stirring and an emulsified dispersion was gradually obtained.

COMPARATIVE EXAMPLE 1

1) A sample obtained by omitting the compound (32) in example 6 (Sample A)

2) Comparative sample B was prepared in the same way except that the water soluble ultraviolet absorbing dye indicated below (0.05 g/m$^2$) was used in place of compound (32) in example 6.

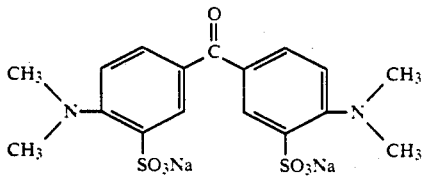

Evaluation of Performance (1) The three samples described above were exposed through an optical wedge using a daylight printer P-607 made by the Dainippon Screen Co. and then developed for 20 seconds at 38° C. in the development bath indicated below, after which they were fixed, washed and dried in a conventional way.

| Basic Development Bath Formula | |
|---|---|
| Hydroquinone | 35.0 g |
| N-Methyl-p-aminophenol hemi-sulfate | 0.8 g |
| Sodium sulfite | 13.0 g |
| 5-Sulfosalicylic acid | 74.0 g |
| Potassium sulfite | 90.0 g |
| Ethylenediamine tetra-acetic acid, tetra-sodium salt | 1.0 g |
| Potassium bromide | 4.0 g |
| 5-Methylbenzotriazole | 0.6 g |
| 3-Diethylamino-1,2-propanediol | 15.0 g |
| Water to make up to | 1 l |
| pH | 11.5 |

Sample B and sample 1 both had a UV optical density in the highlights similar to or lower than that of sample A and they had been completely decolorized.

The speed, with respect to comparative sample A, of sample B was lowered by 0.4 as a log E value, and it was lowered by 0.5 with sample 1 of this invention. In practice, the speeds of sample B and sample 1 were in a useful range.

(2) Safe-light Safety Test

The safe time under a UV cut fluorescent lamp safe-light [FLR-40SW-DLX-NU/M, made by Toshiba] at 400 lux was tested for the three samples described above. The safe time for comparative sample A was 10 minutes, while comparative sample B was safe for 25 minutes and sample 1 of this invention was safe for 35 minutes.

According to the results obtained in (1) and (2) above, compound (32) of this invention reduced the speed more effectively into the practical region and improved safe-light safety.

(3) Tone Variability Test

The three samples described above were exposed through a flat mesh screen using the printer described above and then they were processed in the same way as in the test described in (1) above. The exposure time for providing a net reduction area of 1:1 was determined for each sample, after which exposure were made with exposure times 2 and 4 times this exposure time and the extent to which the screen dot area was increased was investigated. The larger the value obtained, the better the tone variability. The results obtained were as shown in table 5, from which it is clear that while comparative sample B had markedly reduced tone variability, sample 1 of this invention had a high tone variability. This is because the dye used in comparative sample B is water soluble and diffusible so that it diffuses uniformly from the layer to which it has been added into the photosensitive emulsion layer, so that even when the exposure time is increased any increase in the screen dot area is suppressed by the anti-irradiation effect due to this dye. On the other hand, compound (32) of this invention is fixed in the layer to which it has been added and so the material displays a high tone variability.

TABLE 5

| Sample No. | Tone Variability (Shown by the Increase in Halftone Dot Area) Double Exposure | Quadruple Exposure |
|---|---|---|
| Sample A (Comparative Example) | −5% | −9% |
| Sample B (Comparative Example) | −2% | −4% |
| Sample 1 (This Invention) | −5% | +9% |

(4) Evaluation of Staining by Reducing Bath

A strip of the sample 1 of this invention obtained by processing in (3) above was immersed for 60 seconds at 20° C. in the Farmer's reducer indicated below, washed with water and dried. The results obtained showed that the location where the screen dot area was 50% had been reduced to 33% and it was confirmed that no staining had occurred.

| Farmer's Reducer | | |
|---|---|---|
| Solution 1: | Water | 200 ml |
| | Sodium thiosulfate | 20 g |
| Solution 2: | Water | 100 ml |
| | Potassium ferricyanide | 10 g |

For use, solution 1, 2 and water were mixed in the proportions of 100 parts solution 1:5 parts solution 2:100 parts water.

EXAMPLE 7

Samples 2a, 2b, 2c, 2d and 2e were prepared using $1.26\times10^{-4}$ mol/m$^2$ of the compounds (33), (35), (37), (44) and (45) of this invention instead of compound (32) of this invention in example 6, and these samples were evaluated in the same way as in example 6.

The results obtained showed that, as in the case of sample 1 in example 6, the speed was reduced effectively into a practical region, the safe-light safety was high and they exhibited a high degree of tone variability. No staining was produced by the reducing bath.

EXAMPLE 8

Compound (32) of this invention was dissolved using the oils and auxiliary solvents indicated below and an emulsified dispersion in gelatin was then prepared using a homogenizer. After emulsification and dispersion, the emulsion was washed by noodle washing and, finally, water was added to make up to 300 grams.

| | |
|---|---|
| Gelatin (10 wt % aqueous solution) | 100 g |
| Sodium nonylphenylsulfonate | 0.5 g |
| Compound (32) of the invention | 5.8 g |
| Tricresyl phosphate | 5.8 g |
| Cyclohexanone | 26 ml |
| Ethyl acetate | 26 ml |
| Water to make up to | 300 g |

Example 6 was then repeated using the emulsified dispersion so obtained instead of compound (32) in example 6.

The results obtained were good, like those obtained with sample 1.

EXAMPLE 9

The multi-layer color photosensitive material 9-1 was prepared by the lamination coating of the each of the layers of which the compositions are indicated below on a cellulose triacetate film support which had been provided with an under-layer.

Photosensitive Layer Compositions

The number for each component shows the amount coated in units of g/m$^2$, and in the case of the silver halides the amount coated is indicated a the amount calculated as silver. However, the coated weights for the sensitizing dyes are indicated in units of mols per mol of silver halide in the same layer.

| | |
|---|---|
| First Layer (Anti-halation Layer) | |
| Black colloidal silver | 0.2 |
| Gelatin | 1.4 |
| UV-1 | 0.02 |
| UV-2 | 0.04 |
| UV-3 | 0.04 |
| Solv-1 | 0.05 |
| Second Layer (Intermediate Layer) | |
| Fine grained silver bromide (average grain size 0.07 μm) | 0.08 |
| Gelatin | 1.1 |
| ExC-1 | 0.02 |
| ExM-1 | 0.06 |
| UV-1 | 0.03 |
| UV-2 | 0.06 |
| UV-3 | 0.07 |
| Cpd-1 | 0.1 |
| ExF-1 | 0.004 |
| Solv-1 | 0.1 |
| Solv-2 | 0.09 |
| Third Layer (Low Speed Red Sensitive Emulsion Layer) | |
| Silver iodobromide emulsion (6.3 mol % AgI, high internal AgI type, c/s ratio 1/1, diameter of corresponding sphere 0.8 μm, variation coefficient of the corresponding sphere diameter 25%, tabular grains, diameter/thickness ratio 2, coated silver weight 1.5) | |
| Gelatin | 1.7 |
| ExC-2 | 0.3 |
| ExC-3 | 0.02 |
| ExS-1 | $7.1\times10^{-5}$ |

-continued

| | |
|---|---|
| ExS-2 | $1.9 \times 10^{-5}$ |
| ExS-3 | $2.4 \times 10^{-4}$ |
| ExS-4 | $4.2 \times 10^{-5}$ |
| Solv-2 | 0.03 |
| Fourth Layer (Intermediate Speed Red Sensitive Emulsion Layer) | |
| Silver iodobromide emulsion (4.8 mol % AgI, high internal AgI type, c/s ratio 1/4, diameter of corresponding sphere 0.9 μm, variation coefficient of the corresponding sphere diameter 50%, tabular grains, diameter/thickness ratio 1.5, coated silver weight 1.4) | |
| Gelatin | 2.1 |
| ExC-2 | 0.4 |
| ExC-3 | 0.002 |
| ExS-1 | $5.2 \times 10^{-5}$ |
| ExS-2 | $1.4 \times 10^{-5}$ |
| ExS-3 | $1.8 \times 10^{-4}$ |
| ExS-4 | $3.1 \times 10^{-5}$ |
| Solv-2 | 0.5 |
| Fifth Layer (High Speed Red Sensitive Emulsion Layer) | |
| Silver iodobromide emulsion (10.2 mol % AgI, high internal AgI type, c/s ratio 1/2, diameter of corresponding sphere 1.2 μm, variation coefficient of the corresponding sphere diameter 35%, tabular grains, diameter/thickness ratio 3.5, coated silver weight 2.1) | |
| Gelatin | 2.0 |
| ExC-1 | 0.06 |
| ExC-4 | 0.04 |
| ExC-5 | 0.2 |
| ExS-1 | $6.5 \times 10^{-5}$ |
| ExS-2 | $1.7 \times 10^{-5}$ |
| ExS-3 | $2.2 \times 10^{-4}$ |
| ExS-4 | $3.8 \times 10^{-5}$ |
| Solv-1 | 0.1 |
| Solv-2 | 0.3 |
| Sixth Layer (Intermediate Layer) | |
| Gelatin | 1.1 |
| Seventh Layer (Low Speed Green Sensitive Emulsion Layer) | |
| Silver iodobromide emulsion (6.3 mol % AgI, high internal AgI type, c/s ratio 1/1, diameter of corresponding sphere 0.8 μm, variation coefficient of the corresponding sphere diameter 25%, tabular grains, diameter/thickness ratio 2, coated silver weight 0.6) | |
| Gelatin | 0.8 |
| ExM-2 | 0.3 |
| ExM-1 | 0.03 |
| ExM-3 | 0.05 |
| ExY-1 | 0.04 |
| ExS-5 | $3.1 \times 10^{-5}$ |
| ExS-6 | $1.0 \times 10^{-4}$ |
| ExS-7 | $3.8 \times 10^{-4}$ |
| H-1 | 0.04 |
| H-2 | 0.01 |
| Solv-2 | 0.2 |
| Eighth Layer (Intermediate Speed Green Sensitive Emulsion Layer) | |
| Silver iodobromide emulsion (4.8 mol % AgI, high internal AgI type, c/s ratio 1/4, diameter of corresponding sphere 0.9 μm, variation coefficient of the corresponding sphere diameter 50%, tabular grains, diameter/thickness ratio 1.5, coated silver weight 1.1) | |
| Gelatin | 1.4 |
| ExM-4 | 0.2 |
| ExM-5 | 0.05 |
| ExM-1 | 0.01 |
| ExM-3 | 0.01 |
| ExY-1 | 0.02 |
| ExS-5 | $2.0 \times 10^{-5}$ |
| ExS-6 | $7.0 \times 10^{-5}$ |
| ExS-7 | $2.6 \times 10^{-4}$ |
| H-1 | 0.07 |
| H-2 | 0.02 |
| Solv-1 | 0.06 |
| Solv-2 | 0.4 |
| Ninth Layer (High Speed Green Sensitive Emulsion Layer) | |
| Silver iodobromide emulsion (10.2 mol % AgI, high internal AgI type, c/s ratio 1/2, diameter of corresponding sphere 1.2 μm, variation coefficient of the corresponding sphere diameter 38%, tabular | |

-continued

| | |
|---|---|
| grains, diameter/thickness ratio 4, coated silver weight 2.1) | |
| Gelatin | 2.2 |
| ExC-2 | 0.02 |
| ExM-5 | 0.1 |
| ExM-1 | 0.05 |
| ExS-5 | $3.5 \times 10^{-5}$ |
| ExS-6 | $8.0 \times 10^{-5}$ |
| ExS-7 | $3.0 \times 10^{-4}$ |
| Solv-1 | 0.08 |
| Solv-2 | 0.7 |
| Tenth Layer (Yellow Filter Layer) | |
| Yellow colloidal silver | 0.08 |
| Gelatin | 1.0 |
| Cpd-1 | 0.1 |
| Eleventh Layer (Low Speed Blue Sensitive Emulsion Layer) | |
| Silver iodobromide emulsion (9.0 mol % AgI, high internal AgI type, c/s ratio 1/2, diameter of corresponding sphere 0.75 μm, variation coefficient of the corresponding sphere diameter 21%, octahedral grains, diameter/thickness ratio 1, coated silver weight 0.3) | |
| Gelatin | 1.3 |
| ExY-2 | 0.7 |
| ExY-1 | 0.03 |
| H-1 | 0.03 |
| H-2 | 0.01 |
| Solv-2 | 0.3 |
| Twelfth Layer (Intermediate Speed Blue Sensitive Emulsion Layer) | |
| Silver iodobromide emulsion (10.2 mol % AgI, high internal AgI type, c/s ratio 1/2, diameter of corresponding sphere 1.0 μm, variation coefficient of the corresponding sphere diameter 30%, tabular grains, diameter/thickness ratio 3.5, coated silver weight 0.4) | |
| Gelatin | 0.7 |
| ExY-2 | 0.1 |
| ExS-8 | $2.2 \times 10^{-4}$ |
| H-1 | 0.01 |
| H-2 | 0.005 |
| Solv-2 | 0.05 |
| Thirteenth Layer (High Speed Blue Sensitive Emulsion Layer) | |
| Silver iodobromide emulsion (9.0 mol % AgI, high internal AgI type, c/s ratio 1/2, diameter of corresponding sphere 1.8 μm, variation coefficient of the corresponding sphere diameter 55%, octahedral grains, diameter/thickness ratio 6.5, coated silver weight 0.8) | |
| Gelatin | 0.7 |
| ExY-2 | 0.2 |
| ExS-8 | $2.3 \times 10^{-4}$ |
| Solv-2 | 0.07 |
| Fourteenth Layer (First Protective Layer) | |
| Gelatin | 0.9 |
| UV-4 | 0.1 |
| UV-5 | 0.2 |
| H-1 | 0.02 |
| H-2 | 0.005 |
| Solv-3 | 0.03 |
| Cpd-2 | 0.7 |
| Fifteenth Layer (Second Protective Layer) | |
| Fine grained silver bromide emulsion | 0.1 |
| Gelatin | 0.7 |
| H-1 | 0.2 |
| H-2 | 0.05 |

ExS-1

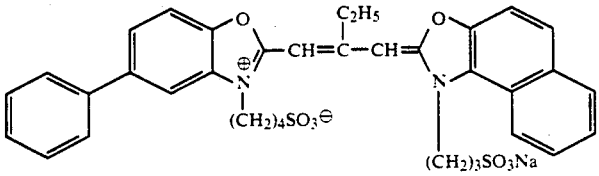

ExS-2

-continued
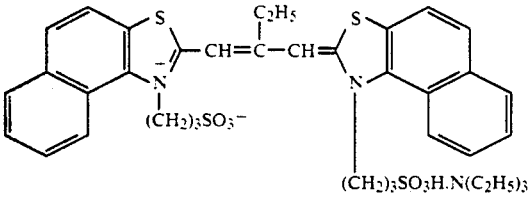
ExS-3
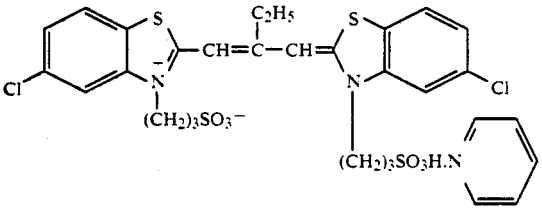
ExS-4
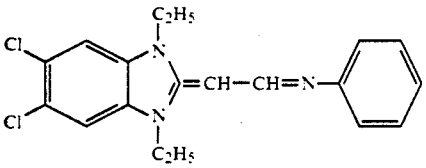
ExS-5
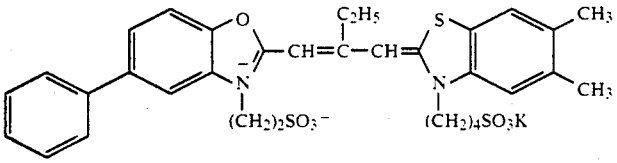
ExS-6
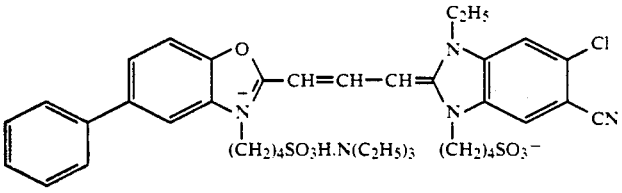
ExS-7
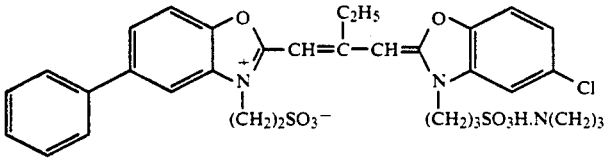
ExS-8
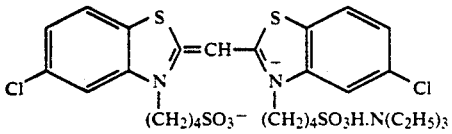
ExC-1

-continued
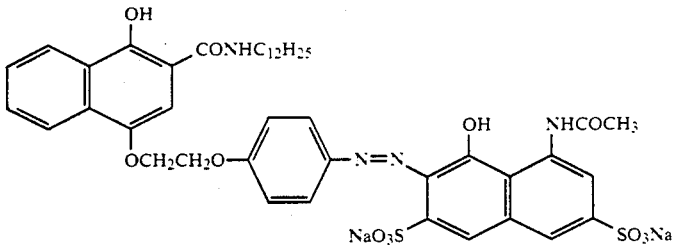
ExC-2
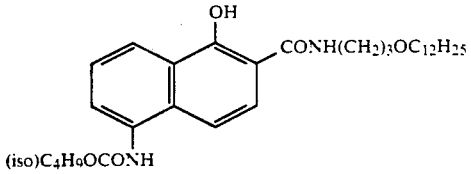
ExC-3
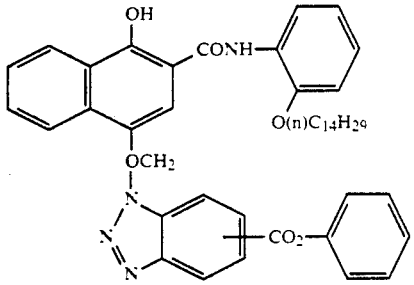
ExC-4
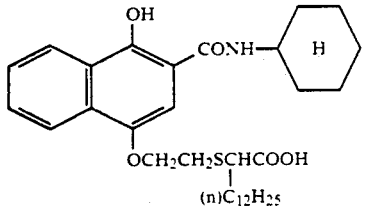
ExC-5
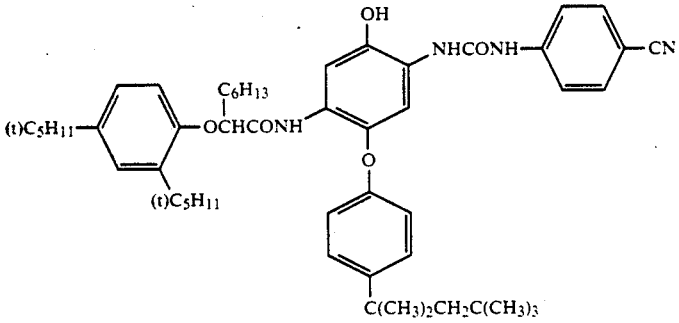
ExM-3

-continued
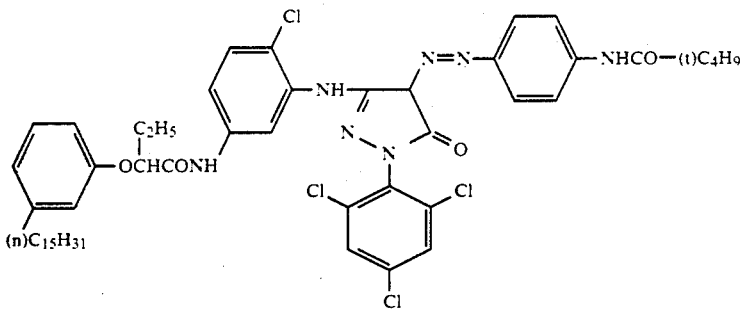
ExM-1
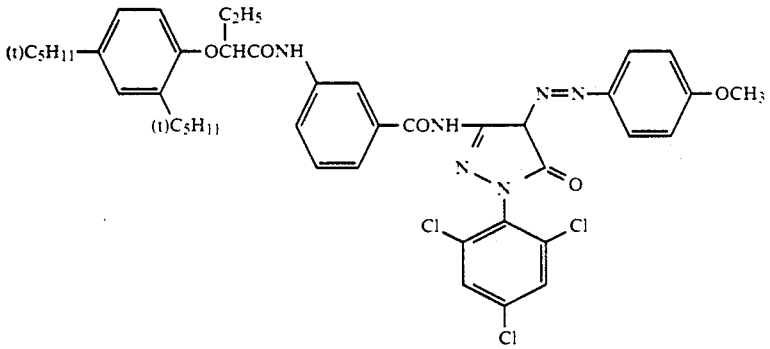
ExM-5
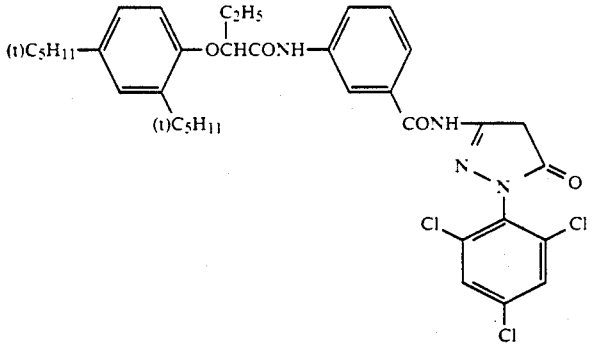
ExM-2
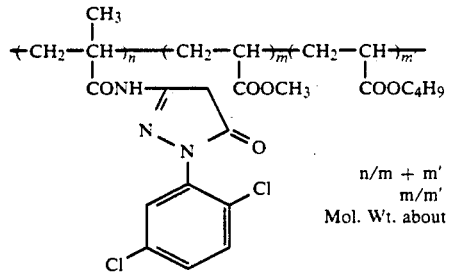
n/m + m' = 1
m/m' = 1
Mol. Wt. about 40,000
ExM-4

-continued
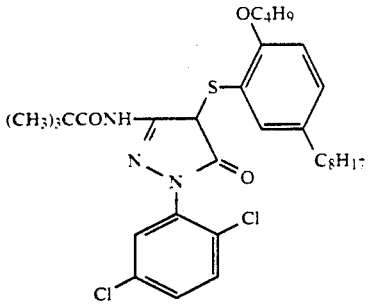
ExY-1
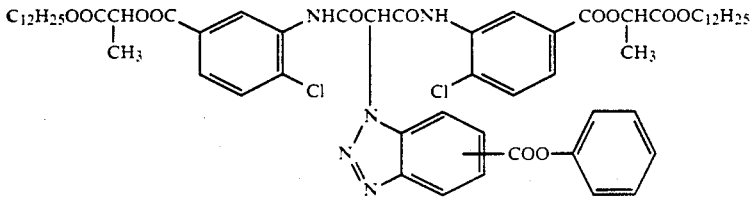
ExY-2
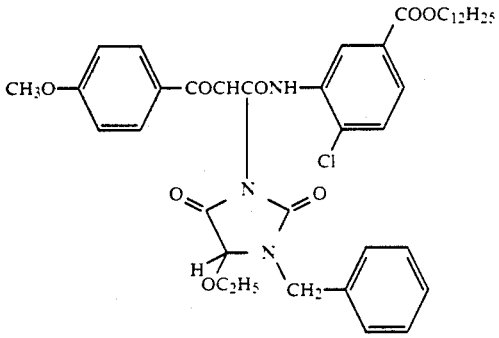
UV-1
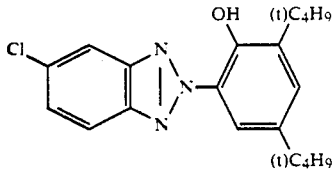
UV-2
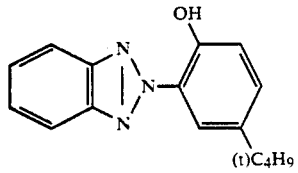
UV-3
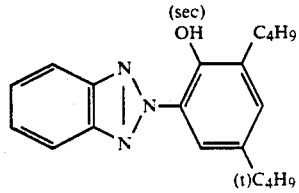
UV-4

-continued

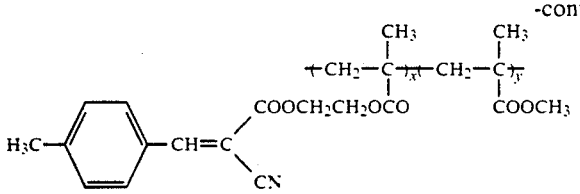

x/y = 7/3 (wt/wt)

UV-5

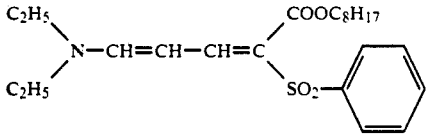

ExF-1

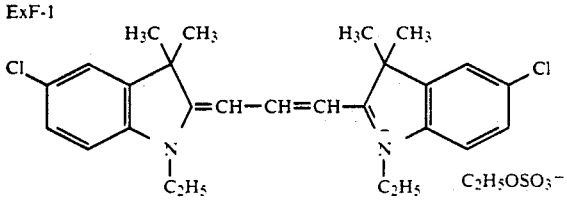

Cpd-1

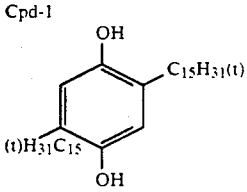

Cpd-2

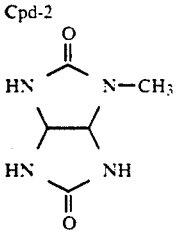

Solv-1 Di-n-butyl Phthalate
Solv-2 Tricresyl Phosphate
Solv-3 Trihexyl Phosphate

H-1

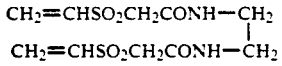

H-2

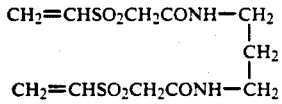

Preparation of Samples 9-2 and 9-3

Sample 9-2 was prepared in the same way as sample 9-1 except that 0.2 gram of the compound A indicated below was added as a comparative compound in place of the yellow colloidal silver in the tenth layer of sample 9-1.

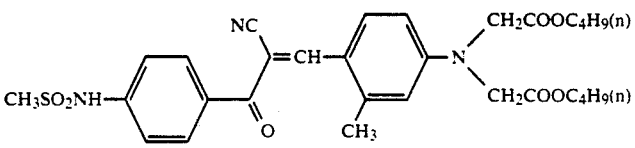

Compound A (A yellow dye disclosed in JP-A-61-205934)

Furthermore, sample 9-3 was prepared in the same way as sample 9-2 except that 0.2 gram of the compound B indicated below was added in place of the compound A is sample 9-2.

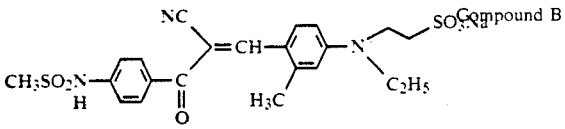

Preparation of Samples 9-4 and 9-5

These were prepared in the same way as sample 9-2 except that an equimolar amount of a compound of this invention was used in place of the compound A in the tenth layer of sample 9-2.

The samples 9-1 to 9-5 so obtained were exposed to white light through a wedge and processed in the way indicated below.

| Process | Processing Method: Processing Time | Processing Temperature |
|---|---|---|
| Color development | 3 min. 15 sec. | 38° C. |
| Bleach | 1 min. 00 sec. | 38° C. |
| Bleach-fix | 3 min. 15 sec. | 38° C. |
| Water wash (1) | 40 sec. | 35° C. |
| Water wash (2) | 1 min. 00 sec. | 35° C. |
| Stabilization | 40 sec. | 38° C. |
| Drying | 1 min. 15 sec. | 55° C. |

The compositions of the processing baths were as follows:

| Color Development Bath | (Units: Grams) |
|---|---|
| Diethylenetriamine penta-acetic acid | 1.0 |
| 1-Hydroxyethylidene-1,1-diphosphonic acid | 3.0 |
| Sodium sulfite | 4.0 |
| Potassium carbonate | 30.0 |
| Potassium bromide | 1.4 |
| Potassium iodide | 1.5 mg |
| Hydroxylamine sulfate | 2.4 |
| 4-(N-Ethyl-N-β-hydroxyethylamino)-2-methylaniline sulfate | 4.5 |
| Water to make up to | 1.0 l |
| pH | 10.05 |
| **Bleach Bath** | (Units: Grams) |
| Ethylenediamine tetra-acetic acid, ferric ammonium salt, di-hydrate | 120.0 |
| Ethylenediamine tetra-acetic acid, di-sodium salt | 10.0 |
| Ammonium bromide | 100.0 |
| Ammonium nitrate | 10.0 |
| Bleach accelerator | 0.005 mol |

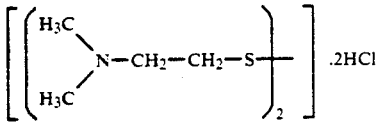

-continued

| | |
|---|---|
| Aqueous ammonia (27%) | 15.0 ml |
| Water to make up to | 1 l |
| pH | 6.3 |
| **Bleach-fix Bath** | (Units: Grams) |
| Ethylenediamine tetra-acetic acid, ferric ammonium salt, di-hydrate | 50.0 |
| Ethylenediamine tetra-acetic acid, di-sodium salt | 5.0 |
| Sodium sulfite | 12.0 |
| Aqueous ammonium thiosulfate Solution (70%) | 240.0 ml |
| Aqueous ammonia (27%) | 6.0 ml |
| Water to make up to | 1 l |
| pH | 7.2 |

Wash Water

City water was passed through a mixed bed column packed with an H type strongly acidic cation exchange resin ("Amberlite IR-120B", made by the Rohm and Hass Co.) and an OH type anionic exchange resin ("Amberlite IR-400", made by the Rohm and Hass Co.) and treated in such a way that the calcium and magnesium concentration were less than 3 mg/l, and then 20 mg/l of isocyanuric acid dichloride, sodium salt, and 150 mg/l of sodium sulfate were added.

The pH of this liquid was within the range from 6.5 to 7.5.

| Stabilizing Bath | (Units:Grams) |
|---|---|
| Formalin (37%) | 2.0 ml |
| Polyoxyethylene p-monononylphenyl ether (average degree of polymerization 10) | 0.3 |
| Ethylenediamine tetra-acetic acid, di-sodium salt | 0.05 |
| Water to make up to | 1 l |
| pH | 5.0–8.0 |

The speed of the blue sensitive layer and $D_{min}$ for the yellow density of the samples obtained were measured and the results obtained are shown in Table 6.

The samples of this invention exhibited little reduction in the speed of the blue sensitive layer relative to the comparative example, and $D_{min}$ for the yellow density was clearly low.

It is thought that this because there is little inter-layer migration of the compound of this invention from the layer to which it has been added (tenth layer) to the adjoining layer (blue sensitive layer) and the fact that the residual coloration is alight because of the excellent decolorizing properties in development processing.

Furthermore, the loss in speed in the green sensitive layer was small when compared to that obtained with colloidal silver, and this is probably because of the good cut of the absorbance of the compounds of this invention on the long wavelength side.

TABLE 6

| Sample No. | Compound Added to the Tenth Layer | Sensitivity of the Blue Layer* | Sensitivity of the Green Layer** | $D_{min}$*** of the Yellow Density |
|---|---|---|---|---|
| 9-1 (Comparative Example) | — | ±0 | ±0 | ±0 |
| 9-2 (Comparative Example) | Compound A | −0.02 | +0.09 | +0.10 |
| 9-3 (Comparative Example) | Compound B | −0.15 | +0.08 | +0.01 |
| 9-4 (Invention) | Compound (33) | −0.01 | +0.11 | +0.01 |

TABLE 6-continued

| Sample No. | Compound Added to the Tenth Layer | Sensitivity of the Blue Layer* | Sensitivity of the Green Layer** | $D_{min}$*** of the Yellow Density |
|---|---|---|---|---|
| 9-5 (Invention) | Compound (59) | ±0.0 | −0.10 | −0.01 |

*Log E required to provide a density of fog − 0.15 relative to that in the case of sample 9-1
**Relative value of Log E required to provide a density of fog − 0.15
***Indicated as the difference from that of sample 9-1

While the invention has been described in detail and with reference to specific embodiments thereof, it will be apparent to one skilled in the art that various changes and modifications can be made therein without departing from the spirit and scope thereof.

What is claimed is:

1. A silver halide photographic material comprising a support having thereon at least one silver halide photosensitive emulsion layer, at least one layer of the material comprising a blocked photographic reagent precursor represented by formula (I):

(I)

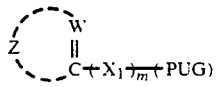

wherein $X_1$ represents a divalent linking group containing a heteroatom bonded to the carbon atom, provided that $X_1$ is linked to the carbon atom by a group other than

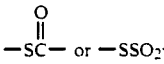

PUG represents a photographically useful group containing a hetero atom bonded to $X_1$; W represents =N— or

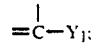

$Y_1$ represents a hydrogen or a group capable of being substituted; Z represents an atomic group necessary for forming a 6-membered heterocyclic ring or a condensed ring containing 6-membered heterocyclic ring selected from pyrazine, triazine, quinazoline, a triazaindene, a tetraazindene, and a pentaazaindene, provided that when W represents a

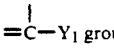

the group adjacent to W in the heterocyclic ring is a group other than

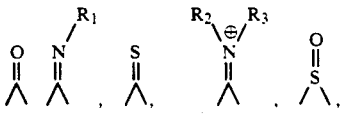

-continued

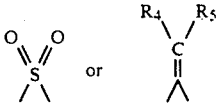

wherein $R_1$, $R_2$, $R_3$, $R_4$ and $R_5$ each represents hydrogen or a group capable of being substituted; and m is 0 or 1, with the proviso that when m is 0, the photographically useful group represented by PUG is bonded to the carbon atom of the heterocyclic ring formed by Z via a heteroatom of PUG.

2. The silver halide photographic material as claimed in claim 1, wherein said photographically useful group represented by PUG is selected from a development inhibitor, an anti-fogging agent, a development accelerator, a nucleating agent, a coupler, a diffusible dye, a non-diffusible dye, a desilvering inhibitor, a silver halide solvent, a competitive compound, a developing agent, an auxiliary developing agent, a fixing accelerator, a fixing inhibitor, an image stabilizer, a toner, a screen dot improving agent, a colored image stabilizer, a photographic dye, a surfactant, a film hardening agent, a desensitizing agent, contrast enhancing agent, a chelating agent, a fluorescent whitener and a DIR-hydroquinone.

3. The silver halide photographic material as claimed in claim 2, wherein PUG represents a development inhibitor selected from a mercaptotetrazole, a mercaptotriazole, a mercaptoimidazole, a mercaptopyrimidine, a mercaptobenzimidazole, a mercaptobenzothiazole, a mercaptobenzoxazole, a mercaptothiadiazole, a benzotriazole, a benzimidazole, an indazole, an adenine, and a guanine.

4. The silver halide photographic material as claimed in claim 2, wherein PUG represents a dye selected from the arylidene dye, a styryl dye, a butadiene dye, an oxonol dye, a cyanine dye, a merocyanine dye, a hemicyanine dye, a diarylmethane dye, a triarylmethane dye, an azomethine dye, an azo dye, an anthraquinone dye, a stilbene dye, a chalcone dye, an indophenol dye, an indoaniline dye, a coumarin dye, an alizarin dye, a nitro dye, a quinoline dye, an indigo dye, and a phthalocyanine dye.

5. The silver halide photographic material as claimed in claim 1, wherein said material a is a photolithographic material; said silver halide emulsion layer comprises silver chlorobromide or silverchloroiodobromide containing at least 60% of silver chloride and 0 to 5% of silver iodide; said photographically useful group is a development inhibitor; and the compound represented by formula (I) is present in an amount of from $1\times10^{-7}$ to $1\times10^{-1}$ mol per mol of said silver halide.

6. The silver halide photographic material as claimed in claim 1, wherein the group capable of being substituted, represented by $Y_1$ is selected from the group consisting of a halogen atom, an alkyl group, an alkenyl group, an aryl group, an alkoxy group, an aryloxy group, an acyloxy group, a carboxylic acid ester group, an amino group, a carbonamido group, a ureido group, a carboxyl group, an oxycarbonyl group, a carbamoyl group, an acyl group, a sulfo group, a sulfonyl group, a sulfamoyl group or a nitro group.

7. A silver halide photographic material according to claim 1, wherein when m is 1, $-(X_1-)_m$PUG represents a group selected from

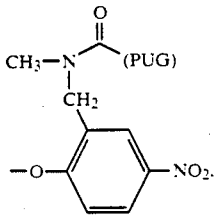

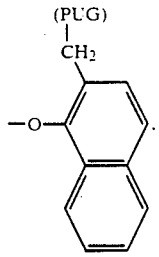

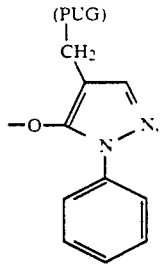

$-OCH_2-(PUG)$.

$-O-\underset{\underset{O}{\|}}{C}-OCH_2-(PUG)$.

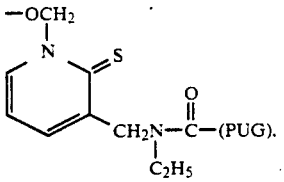

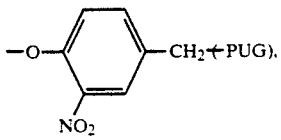

-continued

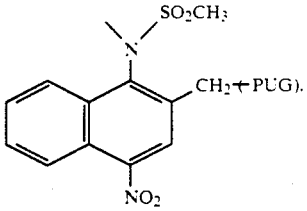

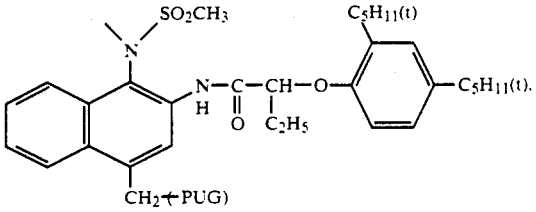

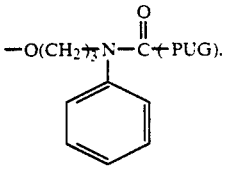

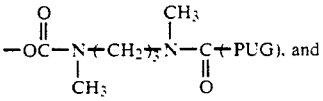

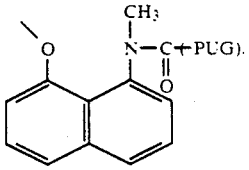

8. The silver halide photographic material as claimed in claim 1, wherein said ring formed by Z is selected from pyrazine, triazine, and quinazoline.

9. The silver halide photographic material as claimed in claim 1, wherein said ring formed by Z is selected from a triazaindene, a tetraazaindene, and a pentaazaindene.

10. The silver halide photographic material as claimed in claim 1, wherein said photographically useful group is an antifoggant or development inhibitor, present in an antifoggant or development inhibitor, present in an amount of from $10^{-8}$ to $10^{-1}$ mol per mol of silver contained in said material.

11. The silver halide photographic material as claimed in claim 1, wherein said photographically useful group is a developing agent, present in amount of $10^{-2}$ to 10 mols per mol of silver in said material.

12. The silver halide photographic material as claimed in claim 1, wherein said photographically useful group is an auxiliary developing agent, present in an amount of from $10^{-4}$ to 10 mols per mol of silver in said material.

13. The silver halide photographic material as claimed in claim 1, wherein said photographically useful group is a nucleating agent, present in an amount of from $10^{-2}$ to $10^{-6}$ mol per mol of silver in said material.

14. The silver halide photographic material as claimed in claim 1, wherein said photographically useful group is a silver halide solvent, present in an amount of $10^{-3}$ to 10 moles per mol of silver in said material.

15. The silver halide photographic material as claimed in claim 1, wherein said photographically useful group a is a photographic dye, present in an amount of $10^{-3}$ to 1 mol per mol of silver in said material.

16. The silver halide photographic material as claimed in claim 5, wherein said lithographic material is a high contrast negative material and said compound represented by formula (I) is present in an amount of from $1\times10^{-6}$ to $10^{-1}$ mole per mol of said silver halide.

17. A silver halide photographic material comprising a support having thereon at least one silver halide photosensitive emulsion layer, at least one layer of the material comprising a blocked photographic reagent precursor represented by the following formula (9), (24), (25), (29), (31), (8), (36), (43), (13), (20), (41), (49), (50) and (58):

(9)

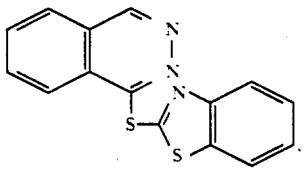

(24)

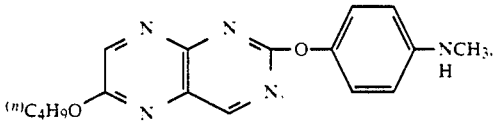

(25)

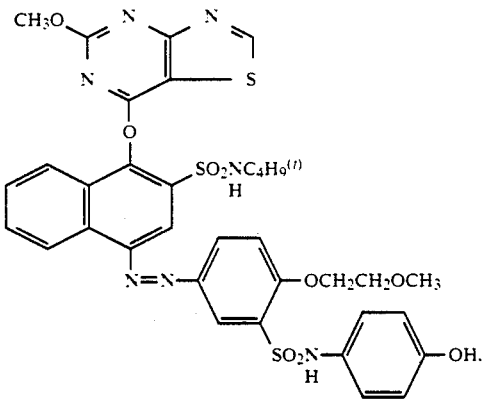

(29)

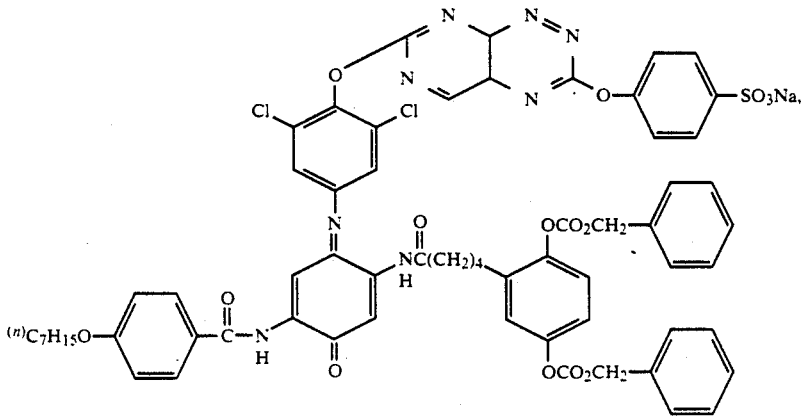

-continued
(31)
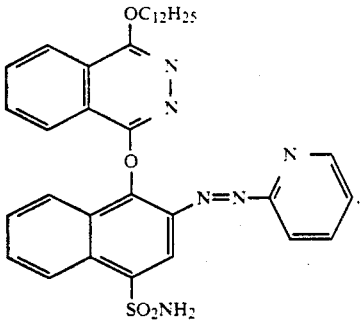
(8)
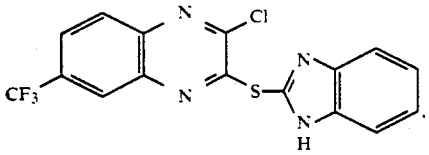
(36)
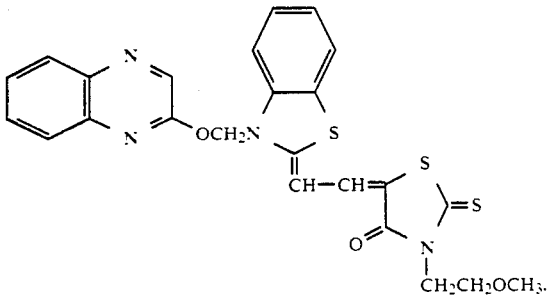
(43)
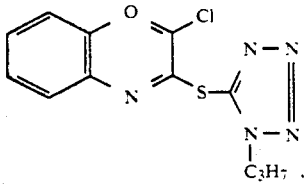
(13)
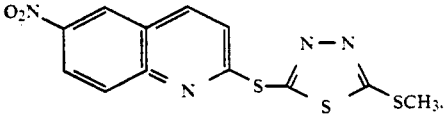
(20)
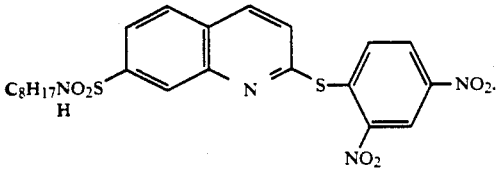
(41)
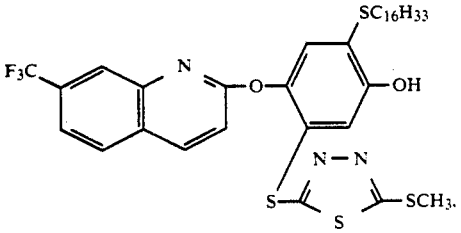

-continued
(49)
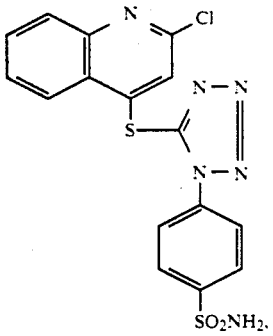
(50)
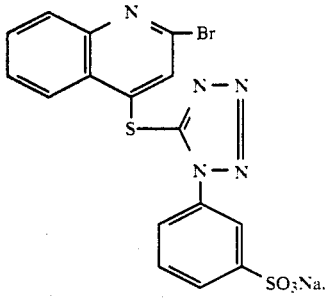
(58)
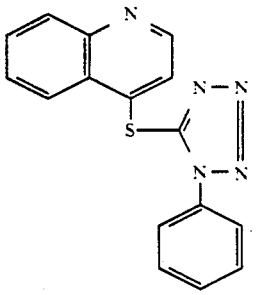
18. A silver halide photographic material comprising a support having thereon at least one silver halide photosensitive emulsion layer, at least one layer of the material comprising a blocked photographic reagent precursor represented by the following formula (5), (19), (46), (54), (6), (42), (51) and (57):
(5)
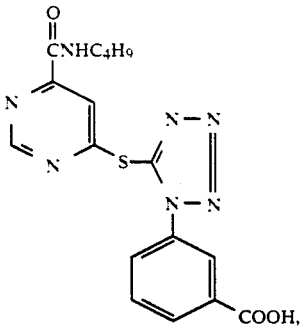
(19)
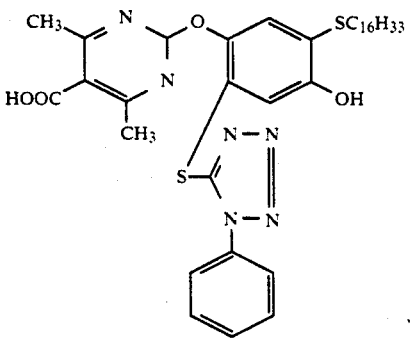

-continued
(46)
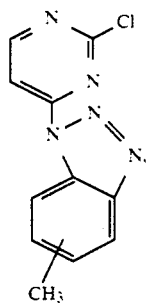
(54)
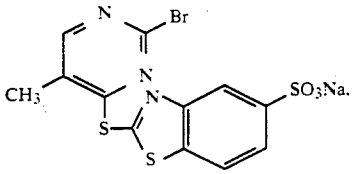
(6)
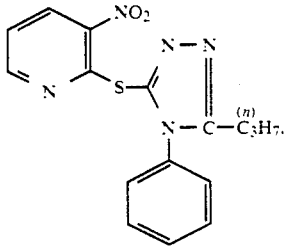
-continued
(42)
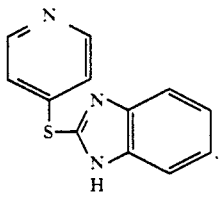
(51)
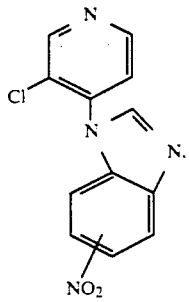
(57)
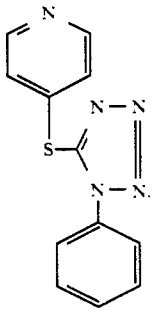
* * * * *